US008341769B2

(12) United States Patent
Fayle et al.

(10) Patent No.: US 8,341,769 B2
(45) Date of Patent: Jan. 1, 2013

(54) GARMENT HAVING ROLL-UP AND STOW SLEEVES

(75) Inventors: Thomas Walker Clarke Fayle, North Vancouver (CA); Brian Hans Pedersen, Lantzville (CA); Anthony Richardson, Okanagon Falls (CA)

(73) Assignee: Arc'Teryx Equipment Inc., North Vancouver, British Columbia (CA)

( * ) Notice: Subject to any disclaimer, the term of this patent is extended or adjusted under 35 U.S.C. 154(b) by 610 days.

(21) Appl. No.: 12/484,167

(22) Filed: Jun. 12, 2009

(65) Prior Publication Data

US 2010/0299798 A1 Dec. 2, 2010

Related U.S. Application Data

(63) Continuation-in-part of application No. 12/476,881, filed on Jun. 2, 2009.

(60) Provisional application No. 61/058,492, filed on Jun. 3, 2008.

(51) Int. Cl.
*A41D 27/10* (2006.01)

(52) U.S. Cl. ..... 2/269; 2/84; 2/85; 2/86; 2/108; 2/125; 2/93

(58) Field of Classification Search ..... 2/84, 85, 2/86, 93, 108, 125, 126, 269
See application file for complete search history.

(56) References Cited

U.S. PATENT DOCUMENTS

| | | | | |
|---|---|---|---|---|
| 1,690,694 | A | 11/1928 | Nissen | |
| 2,073,711 | A * | 3/1937 | Robinsohn | 2/126 |
| 2,715,226 | A | 8/1955 | Weiner | |
| 4,006,495 | A | 2/1977 | Jones | |
| 4,261,059 | A | 4/1981 | Spitz | |
| 4,475,252 | A * | 10/1984 | Peyser et al. | 2/125 |
| 5,692,239 | A * | 12/1997 | Lewis | 2/125 |
| 6,119,270 | A * | 9/2000 | Chou | 2/108 |
| 6,148,445 | A * | 11/2000 | Spruill | 2/125 |
| 6,654,963 | B2 * | 12/2003 | Fayle et al. | 2/84 |
| 7,650,650 | B2 * | 1/2010 | Voege | 2/269 |
| 2006/0277652 | A1 | 12/2006 | Okajima | |
| 2008/0196140 | A1 * | 8/2008 | Mayerson et al. | 2/84 |

FOREIGN PATENT DOCUMENTS

| | | |
|---|---|---|
| EP | 1 535 527 A2 | 6/2005 |
| EP | 1 726 227 A1 | 11/2006 |
| FR | 2 474 285 A1 | 7/1981 |

OTHER PUBLICATIONS

U.S. Appl. No. 12/476,881, Thomas Walker Clarke Fayle et al.

* cited by examiner

*Primary Examiner* — Alissa Tompkins
(74) *Attorney, Agent, or Firm* — Greenblum & Bernstein, P.L.C.

(57) ABSTRACT

The invention relates to a garment that includes a torso portion and a pair of sleeves, with the junction between the torso portion and each of the sleeves including a closable opening. Each of the closable openings includes a first portion positioned on a respective underarm, extending along a side of the torso portion, and a second portion extending on a respective one of the sleeves, with each of the sleeves including a proximal portion adjacent the torso portion, a distal portion adjacent the proximal portion, and an arrangement carried by the proximal portion to maintain the distal portion in a lifted-up state.

37 Claims, 21 Drawing Sheets

GARMENT HAVING ROLL-UP AND STOW SLEEVES

CROSS-REFERENCE TO RELATED APPLICATIONS

This application is a continuation-in-part of prior-filed U.S. patent application Ser. No. 12/476,881, filed Jun. 2, 2009, the disclosure of which is hereby incorporated by reference thereto in its entirety, and the priority of which is hereby claimed under 35 U.S.C. §120, said prior-filed application claiming the benefit of United States prior-filed Provisional Patent Application No. 61/058,492, filed Jun. 3, 2008, the priority of said prior-filed Provisional Application being hereby claimed under 35 U.S.C. §119(e), and the disclosure of said prior-filed Provisional Application being hereby incorporated by reference thereto in its entirety.

BACKGROUND OF THE INVENTION

1. Field of the Invention

The present invention relates to garments or clothes such as jackets and, more particularly, the invention relates to garments structured and arranged to adapt them to weather and temperature changes.

2. Background Information

Under inclement and cold weather conditions, the wearer may desire greater arm dexterity, but may not wish to expose, even temporarily, the upper part of his/her body to inclement weather. In the past, many different types of approaches have been made to provide garments of various types having removable sleeves.

The problem in connection with such sleeves is that frequently there is no convenient storage place for the sleeves once they are detached, so that the detached sleeves might be lost or may be not easily retrieved and reinstalled for arm protection and warmth. Additionally, it is frequently desirable to have a garment which, while being worn, can be easily manipulated so that the sleeves can be removed from arm areas and conveniently stored.

U.S. Pat. No. 4,261,059 discloses a jacket having removable sleeves. The sleeves are attached to the torso portion, or vest portion, of the jacket using a zipper. The path of the zipper is essentially circular and it is positioned at the junction between the torso portion and the sleeve. One length of the zipper extends around the upper and of the sleeve and the other length of the zipper is arranged on the shoulder seams of the torso portion of the jacket. The removed sleeves are stored inside the jacket. This jacket has many disadvantages such as, for example, the need to remove the jacket prior to the removal of the sleeves; or the discomfort of the wearer when the jacket is worn sleeve-less and the zipper-half of the torso portion comes into contact with the armpit. Further, when the jacket is worn without the sleeves, the sleeveless jacket becomes bulky and results in greater warmth from the detached sleeves being stored inside the vest portion of the garment.

Other prior art includes U.S. Pat. No. 4,006,495 and FR 2474285.

U.S. Pat. No. 4,006,495 discloses a coat garment having semi-detachable sleeves and a pocket for receiving such sleeves in their semi-detached condition, the sleeves having essentially longitudinal, selectively openable seams for accommodating arm removal from such sleeves. The sleeves can then be tucked into the pocket provided in a storage pouch provided in the back of the coat proximate the sleeve openings. This coat has the disadvantage that the removal of arms from sleeves still remain uncomfortable for the wearer who doesn't take off the coat. Moreover, the sleeve-less coat becomes bulky and warmer when the sleeves are stored inside the garment and wearer's shoulders are not protected when the garment is worn sleeve-less.

FR 2474285 discloses a garment with retractable sleeves that can be tucked into arm annular pockets. However, those annular pockets still provide discomfort to the wearer and wearer's shoulders are still not protecting when the garment is worn sleeve-less.

SUMMARY OF THE INVENTION

The present invention provides a garment which respond to the disadvantages of the prior art.

In this regard, the invention is directed to a garment that includes a torso portion; a pair of sleeves; a junction between the torso portion and each of the sleeves comprising a closable opening; each of the closable openings including a first portion positioned on the respective underarm, extending along a side of the torso portion, and a second portion extending on the respective one of the sleeves; and each of the sleeves including a proximal portion adjacent to the torso portion; a distal portion adjacent to the proximal portion; an arrangement carried by the proximal portion for maintaining the distal portion in a lifted-up state.

According to additional embodiments of the invention:

- the distal portion is maintained in a rolled-up state;
- the arrangement for maintaining the distal portion in a lifted-up state includes a pocket;
- the arrangement for maintaining the distal portion in a lifted-up state includes snaps;
- the proximal portion and the distal portion include snaps to maintain the proximal portion against the distal portion, in a sleeve-on state;
- the arrangement for maintaining the distal portion is positioned on the upper part of the proximal portion;
- the closable opening between the torso portion and the respective sleeve includes a substantially U-shaped closable-opening with a first portion oriented substantially vertically and a second portion oriented substantially vertically;
- the closable opening between the torso portion and the respective sleeve comprises a double slider zipper;
- the first portion positioned on each underarm, extending along a side of the torso portion and the second portion extending on the respective one of the sleeves, belong to the same piece of fabric;
- the upper proximal portion is lined;
- the arrangement for maintaining the distal portion in a lifted-up state includes an elastic band or a strap, such as an adjustable strap, with or without a pocket and snaps, the strap or band being adapted to extend at least partially around a wearer's arm to apply tension to the lifted-up distal portion of the sleeve against the arm;
- the proximal portion of the sleeve further includes an arrangement to hold the proximal portion of the sleeve against an upper arm of a wearer;
- the arrangement to hold the proximal portion of the sleeve against an upper arm of a wearer includes an elastic band or a strap, such as an adjustable strap.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE INVENTION

Figure 1:
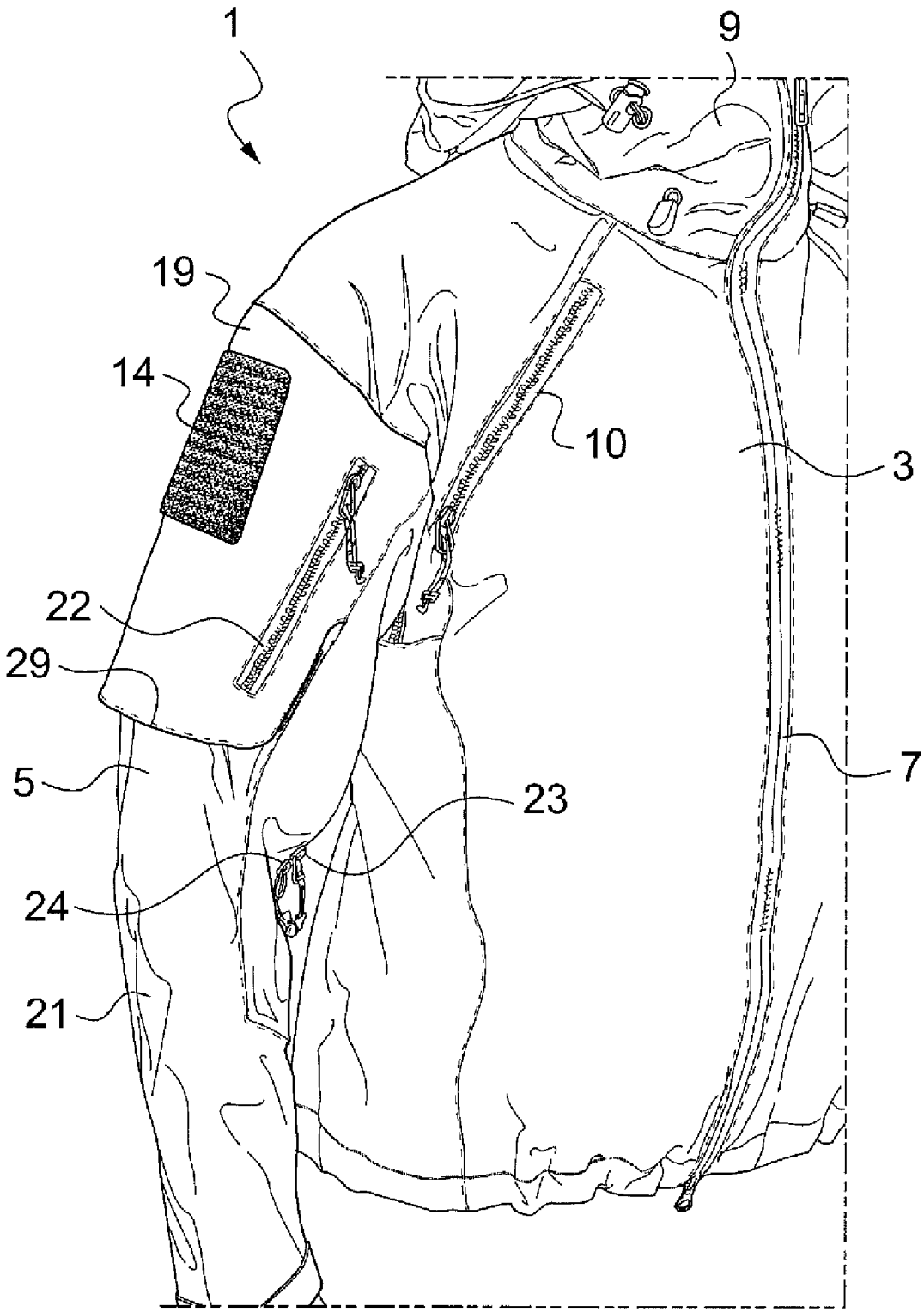
FIG. 1 is a garment worn in a first normal wear position with the sleeve-on state.

In the drawing figures, a garment 1, such as a jacket, includes a torso portion 3 and a pair of sleeves 5, 6, connected to the torso portion 3. The garment 1 is structured and arranged to cover the wearer's upper body.

As used in the description, "vertical" means substantially parallel with respect to a longitudinal axis of the wearer's upper body while standing up.

In the non-limiting embodiment represented in the figures, the garment 1 is closable in a front panel by a principal zipper 7 arranged vertically towards the collar 9. A first storage pocket 10 may be provided on the front upper panel, as represented in FIG. 1. Although zippers are illustrated and referenced herein, fasteners, including slide fasteners of other constructions, are also within the scope of the invention. In addition, although FIG. 1 illustrates a garment according to a first embodiment of the invention, in the form of a jacket, this is not limiting to the invention. For example, the length of the torso portion of the garment could be varied from that shown in the drawing.

The garment 1 includes a junction between the torso portion 3 and each of the sleeves 5, 6. Each junction comprises a closable opening 11.

Figure 2:
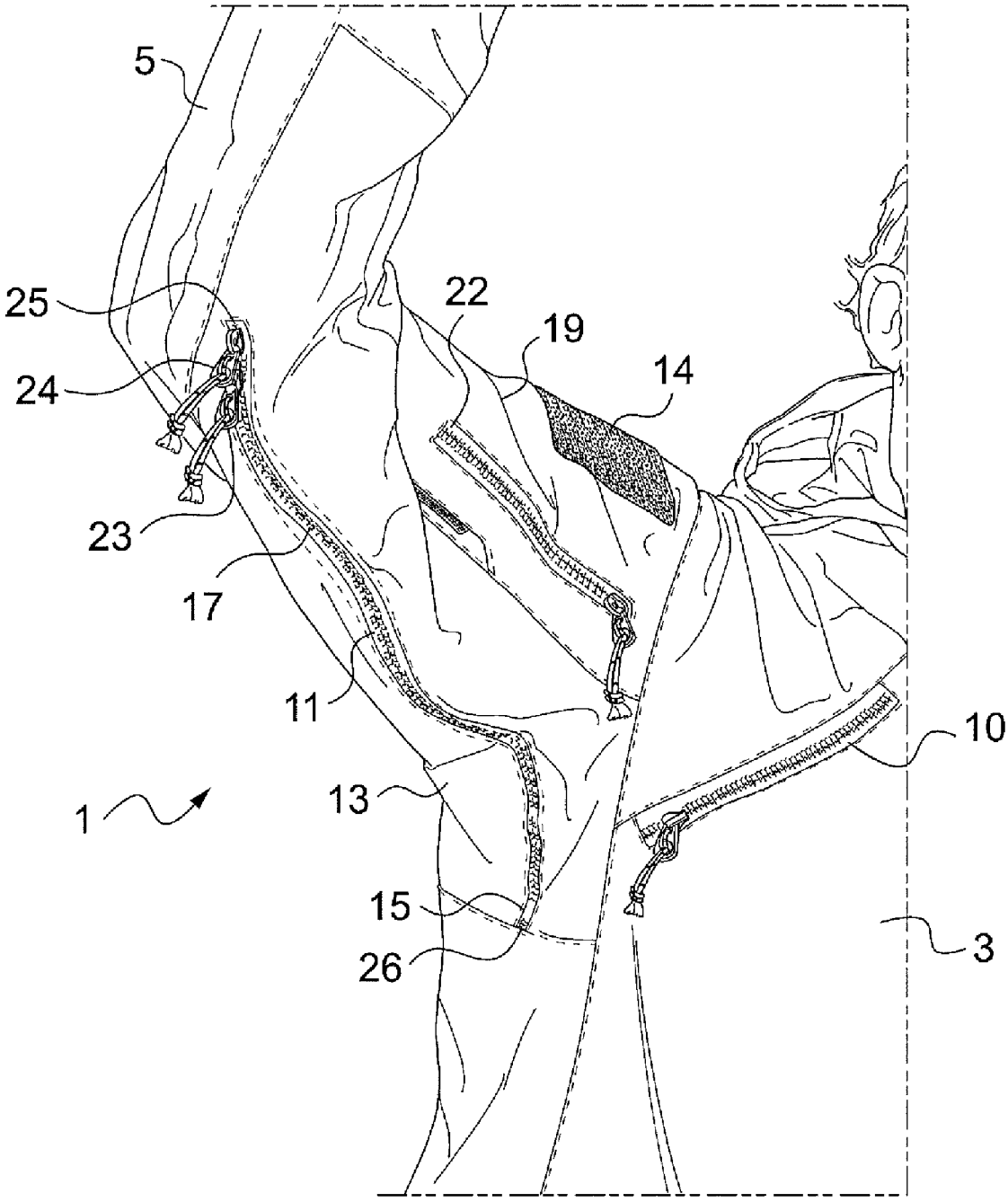
FIG. 2 is similar view to FIG. 1 in which the garment is in the sleeve-on state with raised arm showing a pit zip closed.

As represented in FIG. 2, each of the closable openings 11 includes a first portion 15 positioned on a respective under-arm, extending along a side of the torso portion, and a second portion 17 extending on the respective one of the sleeves 5. The side of the torso portion is shorter than the sleeve 5 and the first portion 15 is positioned at the level of the wearer's armpit.

Each of the sleeves 5, 6 comprises a proximal portion 19 adjacent to the torso portion 3; a distal portion 21 adjacent to the proximal portion 19 that extends further along the arm of the wearer, particularly when the sleeve is in an extended position as shown, e.g., in FIGS. 1 and 2; an arrangement carried by the proximal portion 19 for maintaining the distal portion 21 in a lifted-up state, i.e., in a shortened position, the proximal portion 19 being arranged between the torso portion 3 and the distal portion 21. The proximal portion 19 is attached to the torso region by means of stitching or otherwise.

Thus, the garment 1 can be worn in a "sleeve-on position" (FIGS. 1, 2), covering the arm or in a "sleeve-less position" (FIGS. 11, 12, 13) in which the distal portion 21 of each of the two sleeves is lifted-up by the wearer and maintained in its lifted-up state by a structure at the proximal portion 19. Stated another way, the garment can be worn in an extended-sleeve configuration or in a shortened-sleeve configuration.

The sleeve-less position allows full freedom of the arms 35, 44 while protecting the wearer's torso and shoulders, whereas the sleeve-on position allows full upper body protection including arms 35, 44 needed for example, if the temperature drops.

Each of the extended closable openings 11 provides a large pit opening for passage of the arm 35, allowing an easy withdraw of the arm and elbow 35 and avoiding any discomfort for the wearer in removing his/her arm 35 from the sleeve 5.

Moreover, the proximal portion 19 remains attached to the torso portion 3, thereby allowing good protection of the wearer's shoulders. Each proximal portion 19 is adapted to cover a respective shoulder of the wearer.

The modularity of the garment 1 allows it to be worn with or without sleeves 5, 6, i.e., in either the extended or shortened sleeve configuration, while remaining on the wearer. Moreover, the wearer does not need any exterior help to transform the garment 1.

The closable opening 11 can be slightly positioned more in front portion of torso portion 3 and sleeve 5, to be more easily accessible by the wearer's hand of arm 44.

The removal of the arms 35, 44 from the respective sleeves 5, 6 is easy because there is no need to remove the garment 1 from the wearer's body; the arms 35, 44 are simply slipped out of the sleeves 5, 6 which still remain attached to the garment 1.

The arrangement for maintaining the distal portion 21 in a lifted-up state may be positioned on the upper part of the proximal portion 19 of the sleeve. The upper proximal portion 19 can be lined. This emplacement, on the upper part of the proximal portion 19, allows any discomfort for the wearer to be avoided when the garment 1 is worn sleeve-less. Moreover, the protection of the shoulders is reinforced.

A second storage pocket 22, in the form of an exterior pocket, can be arranged on the proximal portion 19 (see FIG.

1). As shown in FIG. 1, the optional pocket 22 includes a lengthwise-extending zipper. Also, a fastening structure 14 can be arranged on the proximal portion, to attach a blazon for example. The blazon would be visible in both positions "sleeve-on" or "sleeve-less".

In an embodiment shown in FIG. 2, the closable opening 11 between the torso portion 3 and each of the sleeves 5, 6 comprises a substantially U-shaped closable-opening with a first portion 15 oriented substantially vertically on the torso portion 3 and a second portion 17 oriented substantially vertically, with the arm extending along the torso, on the respective one of the sleeves 5, 6.

Figure 6:
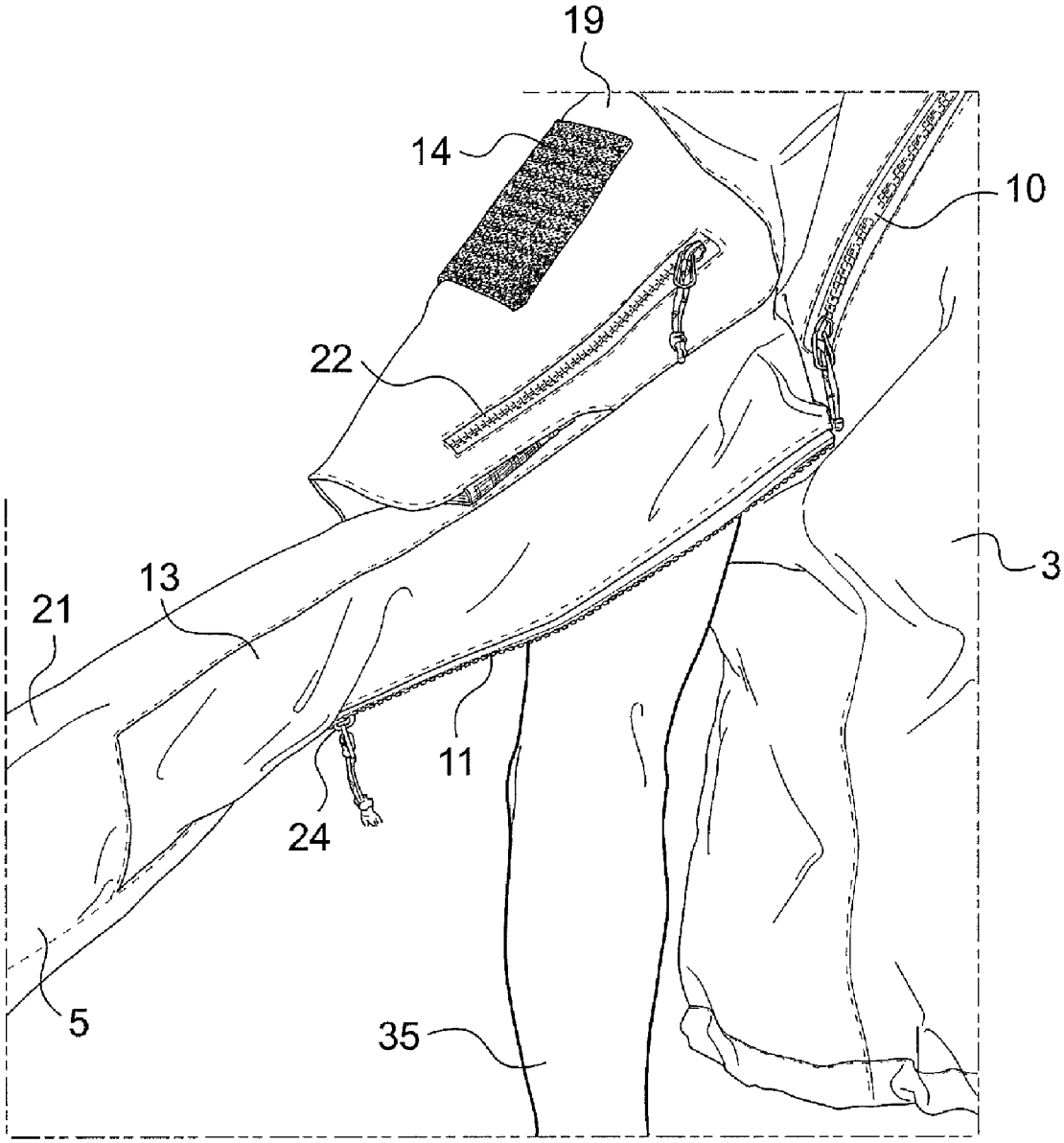
FIG. 6 is similar to FIG. 5, with the arm being removed from the sleeve through the pit zip.

In a further embodiment, the first portion 15 positioned on each underarm and extending along a side of the torso portion and the second portion 17 extending on the respective one of the sleeves 5, 6, belongs to the same piece of fabric 13 (FIGS. 2 and 6).

As seen in FIG. 2, the closable opening 11 comprises a zipper or "pit zip".

The closable opening 11 between the torso portion 3 and the respective sleeve 5 can also comprise a double slider zipper.

The double slider zipper includes a first row of teeth attached to a first stringer, a second row of teeth attached to a second stringer, and an upper slider 23 and a lower slider 24. The sliders 23, 24 are configured in a face-to-face arrangement so that the zipper's teeth are locked together when the sliders 23, 24 are moved from the ends 25, 26 of the stringers towards the middle of the stringers, and open or separate when the sliders 23, 24 are moved in the opposite direction.

Thus, closable opening 11 may be opened by sliding the upper slider 23 or the lower slider 24 to the ends 25, 26 of the stringers and the wearer can readjust the closable opening 11 around his/her arm 35 once withdrawn from the sleeve 5 by closing both sliders 23, 24 towards the middle or leave it open for a better ventilation of the armpit.

According to an embodiment, the distal portion 21 of the sleeve is maintained in a rolled-up state. The distal portion in the rolled-up state allows it to occupy less space in the lifted-up state. To facilitate the roll-up, the distal portion 21 can be done in a slight fabric, such as a thin and/or light-weight fabric.

Moreover, the arrangement comprises a fastening device to maintain the distal portion 21 in the lifted-up, or rolled-up, state.

For example, the arrangement includes a pocket 28, in the form of an interior pocket having an opening 32.

Accordingly, the wearer will not separate the sleeves 5, 6 from the garment 1 but can immediately store them while still wearing the torso portion 3 of the garment 1.

The pocket 28 can be formed by a piece seamed inside an extending sleeve proximal portion 19, on bottom 29 and sides 30 so that the pocket 28 forms a flap on the wearer's shoulder and along an outer surface of the proximal portion of the sleeve.

The pocket interior opening 32 is turned up, along a length of the proximal portion, towards the armpit, so that the distal portion 21 is better retained.

Figure 4:
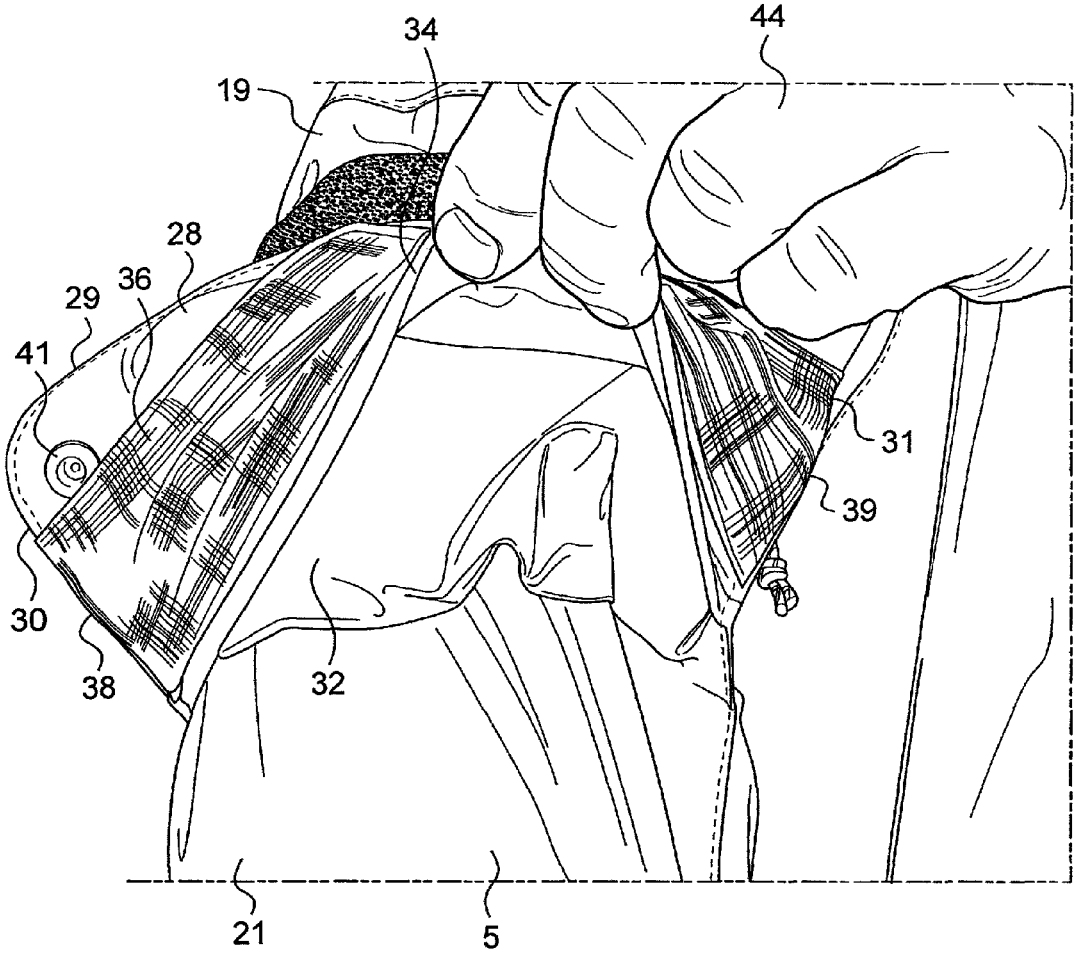
FIG. 4 is similar to FIG. 3 with the garment in the sleeve-on state with the edge of the pocket opening pulled thereby showing the inside of the pocket.

FIG. 4 shows the interior pocket 28 being lifted up by the wearer's hand.

The aperture edge 34 of the opening 32 of the pocket comprises a small elastic, to improve the distal portion 21 being maintained in the lifted-up state in the pocket 28.

The proximal portion 19 of the sleeve 5 can further comprise an arrangement to hold the proximal portion 19 of the sleeve 5 against an upper portion of an arm 35 of a wearer.

Figure 3:
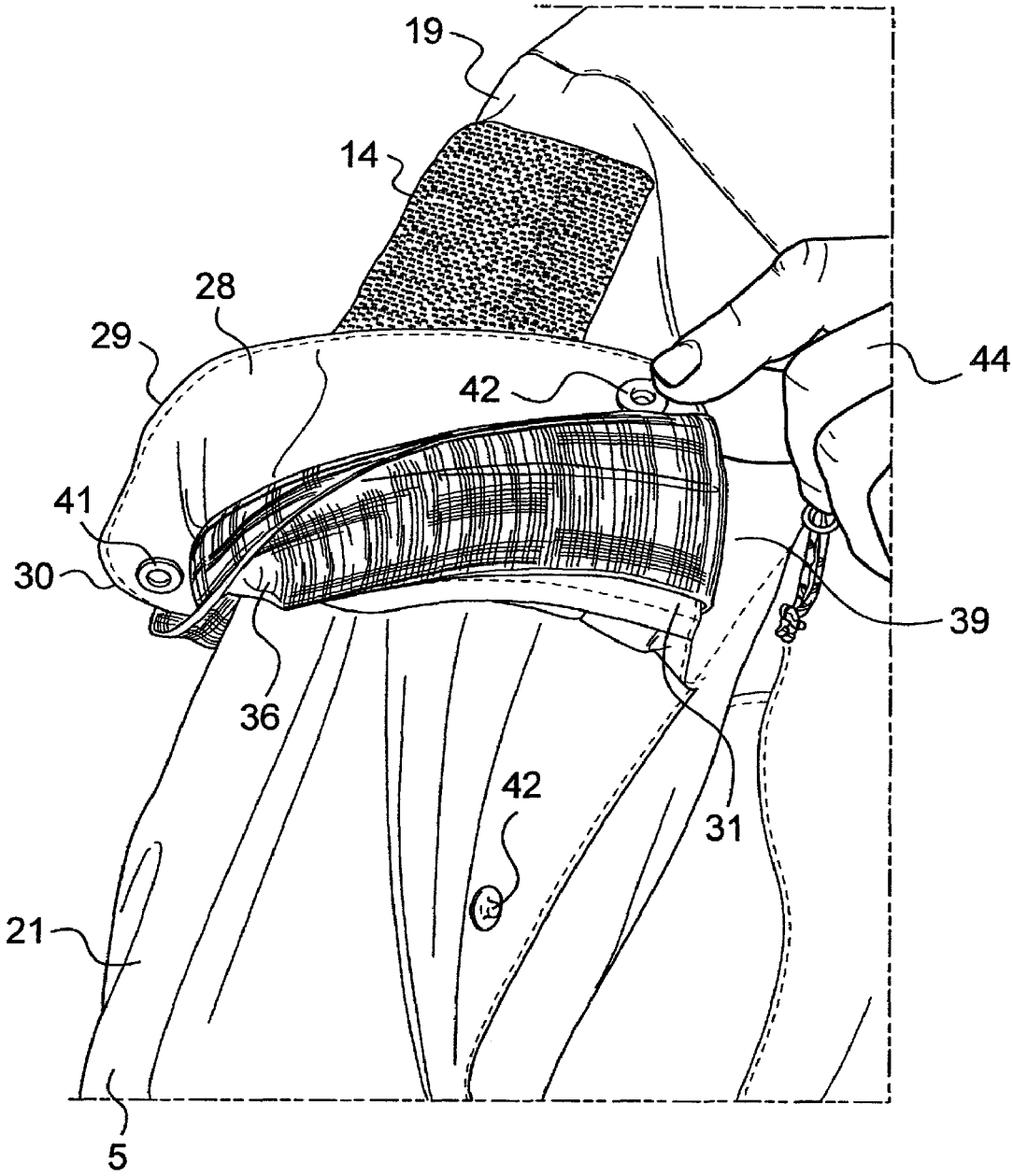
FIG. 3 is similar view to FIG. 1 with the garment in the sleeve-on state with the proximal portion of the sleeve being lifted thereby showing the opening of the pocket.

For example, the arrangement to hold the proximal portion 19 of the sleeve 5 against an upper portion of the arm 35 of a wearer comprises an elastic band 36. The elastic band 36 can be sewn under the pocket 28, on its back side outside to the sleeve 5, at its two spaced-apart ends 38, 39 to the sides 30, 31 of the pocket 28 as can be seen in FIG. 3.

Thus, in the first and second wear position, the arrangement is not visible. Moreover, in the first sleeve-on position, the elastic band 36 is not embarrassing to the wearer. Stated another way, and as shown in the drawing, the arrangement does not extend along the upper surface of the proximal portion across a frontal plane of the garment, i.e., the plane parallel to the long axis of the body and at right angles to the median sagittal plane, dividing the body into front and back portions. The band 36 extends lengthwise transversely along the inner side of the wearer's arm, i.e., facing his/her torso.

The arrangement for maintaining the distal portion 21 can include an elastic band 36 adapted to extend at least partially around a wearer's arm 35 to apply tension to the distal portion 21 of the sleeve 5 against the arm 35.

This elastic band 36 may be the same as the elastic band 36 of the arrangement to hold the proximal portion 19 of the sleeve 5 against an upper arm 35 of a wearer.

The distal portion 21 can therefore stay in position through a full range of motion with minimal restriction and excellent comfort.

In a particular embodiment, the proximal portion 19 and the distal portion 21 comprise snaps 41, 42 to maintain the proximal portion 19 against the distal portion 21 (see FIG. 3). Snaps 41, 42 allow a good-positioning of the arrangement, such as the pocket 28, against the distal portion sleeve 21 in a sleeve-on state.

The proximal portion 19 and the distal portion 21 comprise, for example, a pair of snaps 41, 42 with one snap part between each bottom corner of the bottom pocket 28 and one snap part positioned on corresponding distal portion sleeve 21.

The snaps may be positioned under the pocket 28 to be not visible in normal wear positions.

Figure 11:
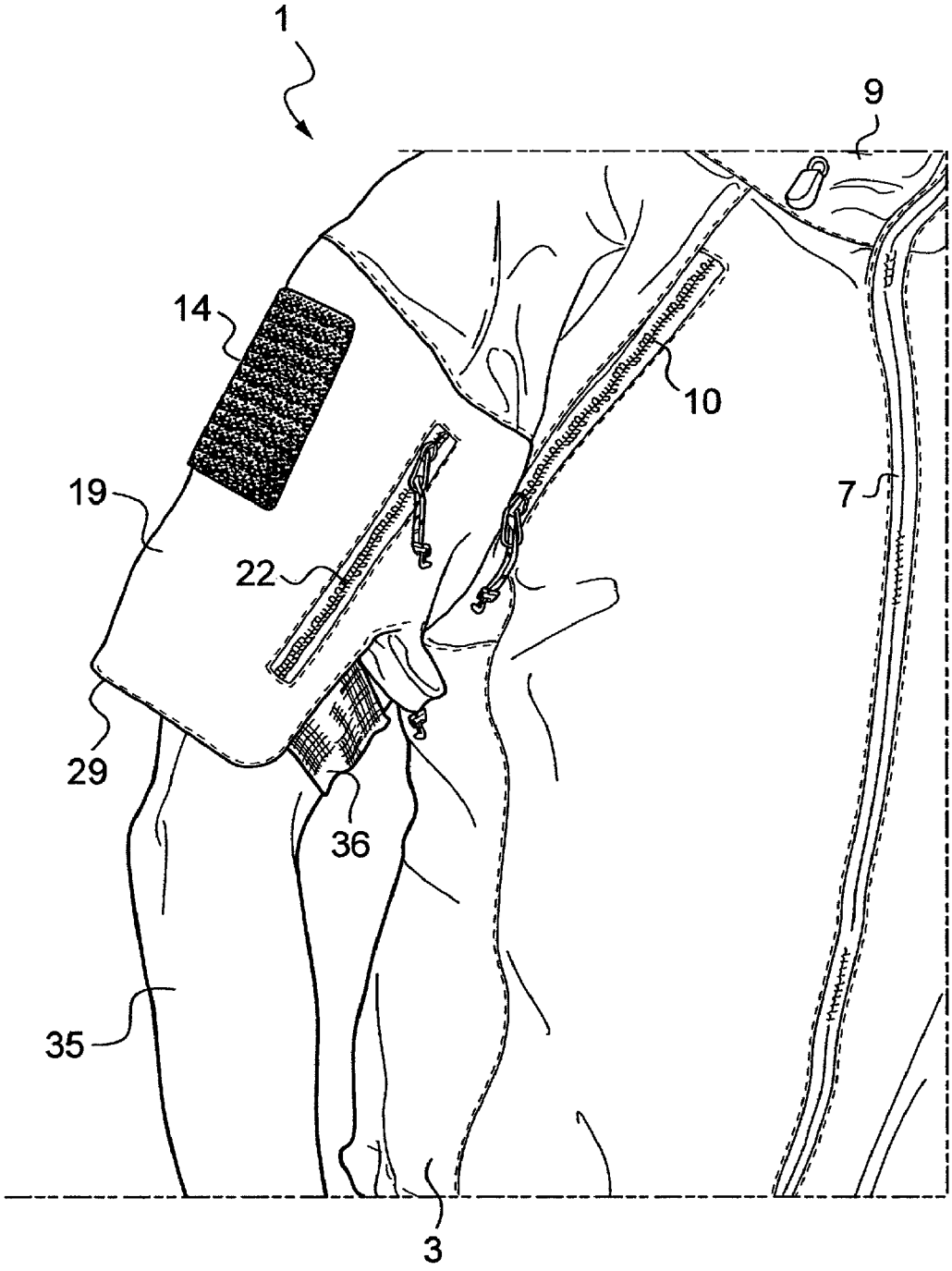
FIG. 11 is similar to FIG. 10 with the garment in the sleeve-less state in the normal wear position, the upper arm and the shoulder being protected.

The figures represent the use of the garment 1 in a sequence from the garment being worn in a first normal sleeve-on state (FIG. 1) to a second normal sleeve-less state (FIG. 11).

From FIG. 1 to FIG. 4, the wearer lifts up the proximal portion 19 comprising the pocket 28 and opens the snaps 41, 42 of the arrangement, to access the pocket opening 32.

Figure 5:
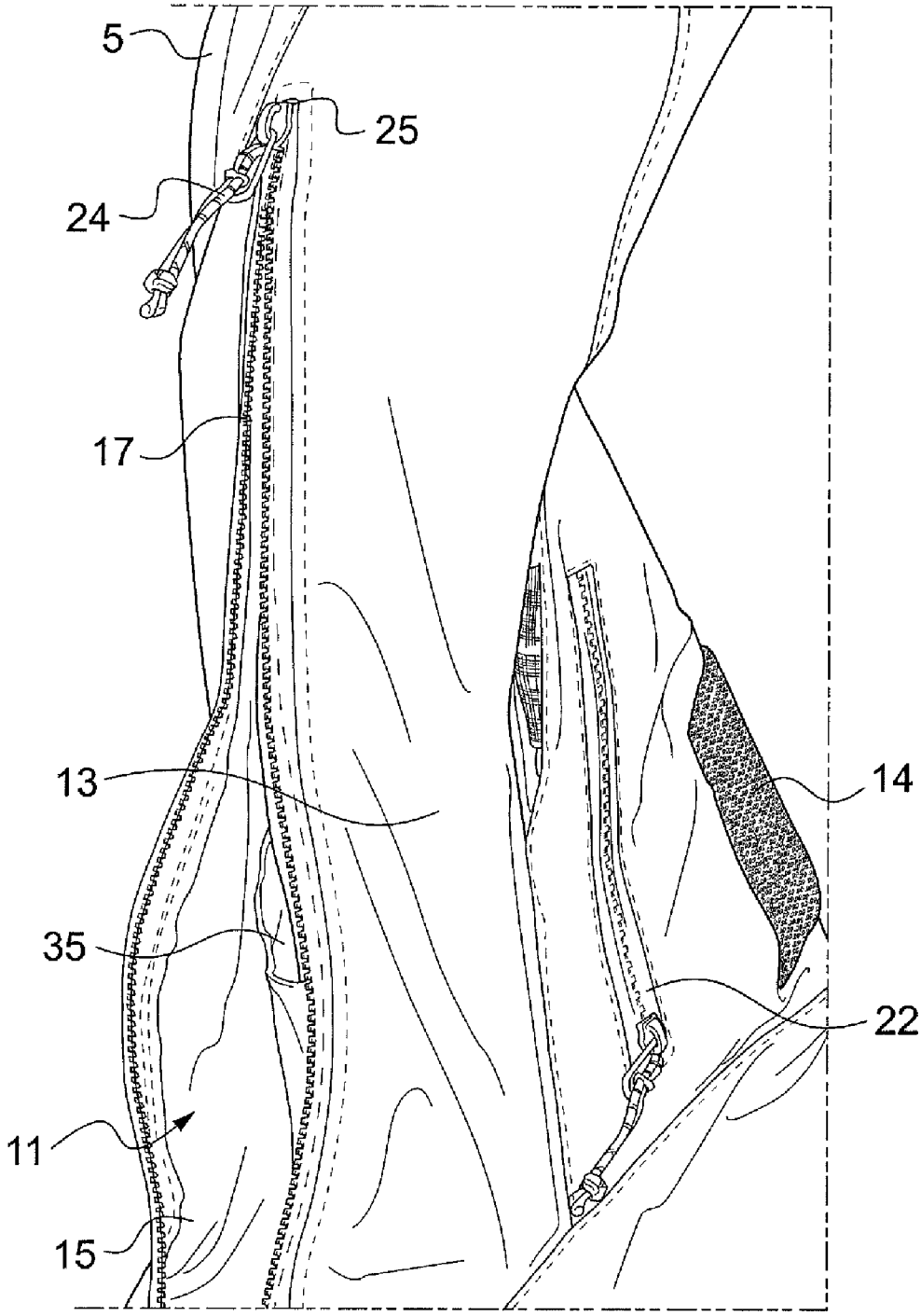
FIG. 5 is similar to FIG. 2, with the garment in the sleeve-on state with raised arm showing the pit zip open.

Then, as shown in FIG. 5, the wearer opens the right closable openings 11 with his/her hand of left arm 44 so the wearer's arm 35 can be withdrawn from the sleeve 5 through the closable opening 11.

In FIG. 6, the wearer pulls out his/her arm 35 from the distal portion 21 of the sleeve 5 through the pit zip closable opening 11.

Figure 7:
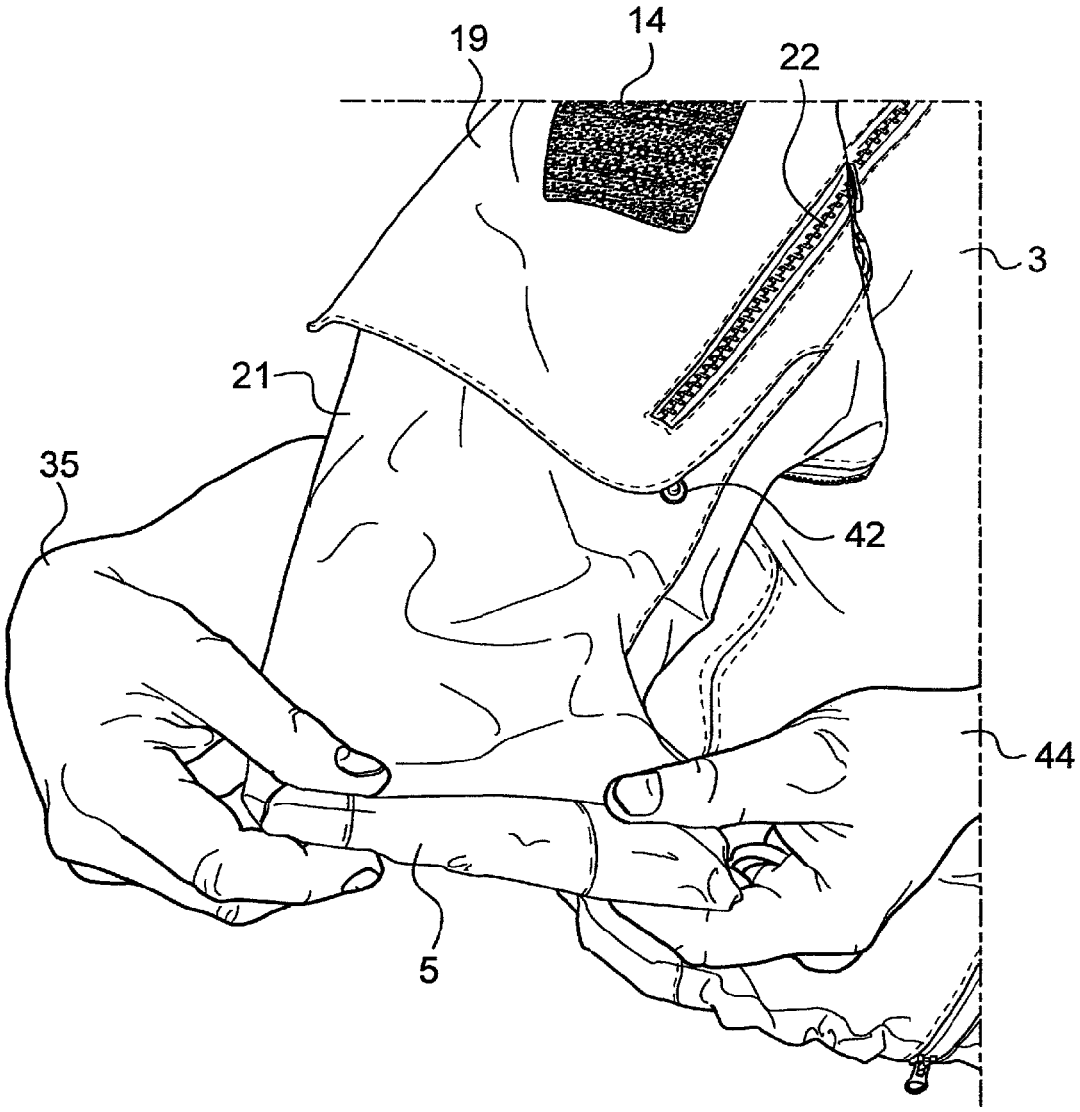
FIG. 7 is similar to FIG. 6, with the sleeve being rolled-up.
Figure 8:
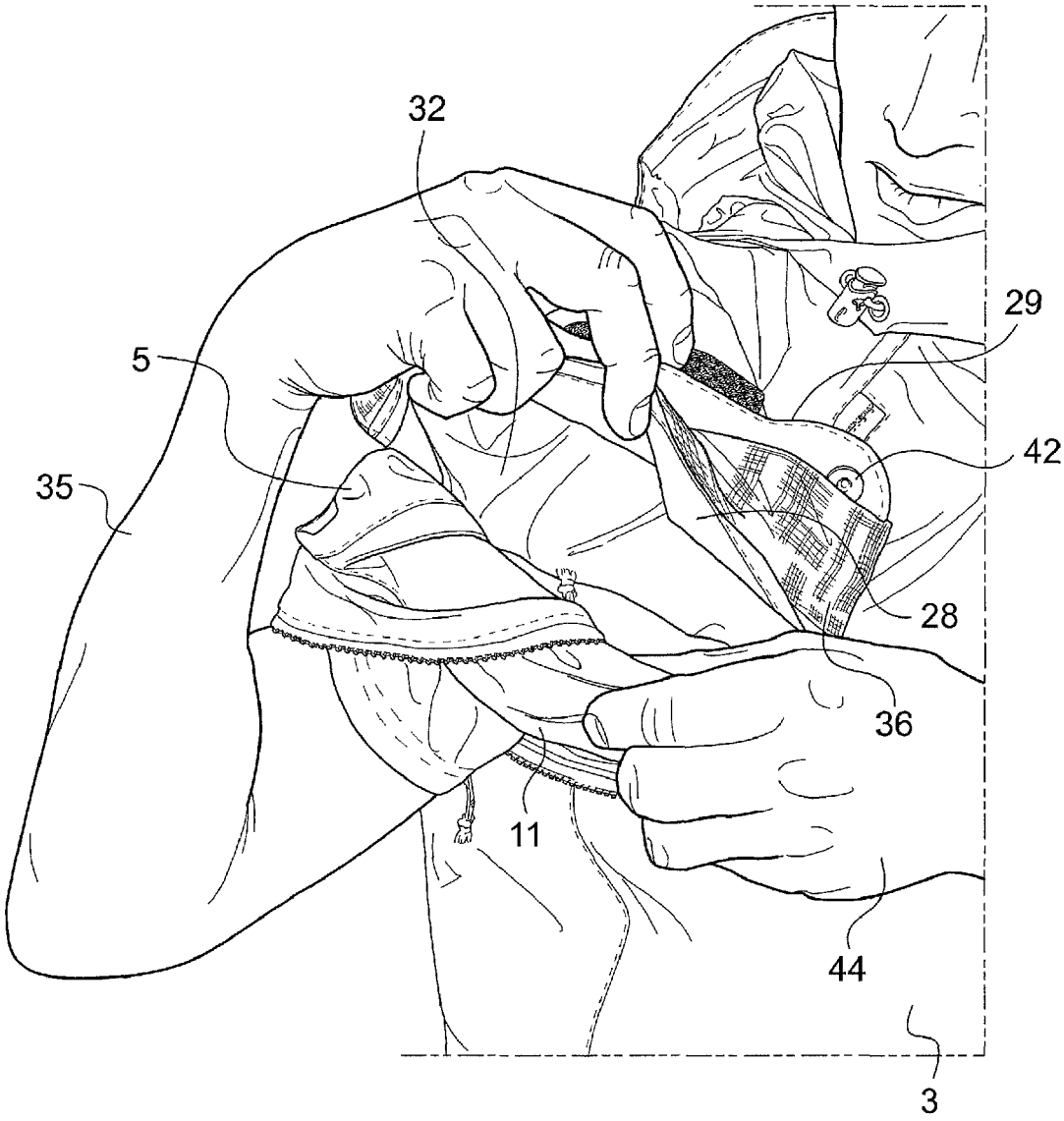
FIG. 8 is similar to FIG. 7, with the sleeve in its rolled-up stated being inserted within the pocket.
Figure 9:
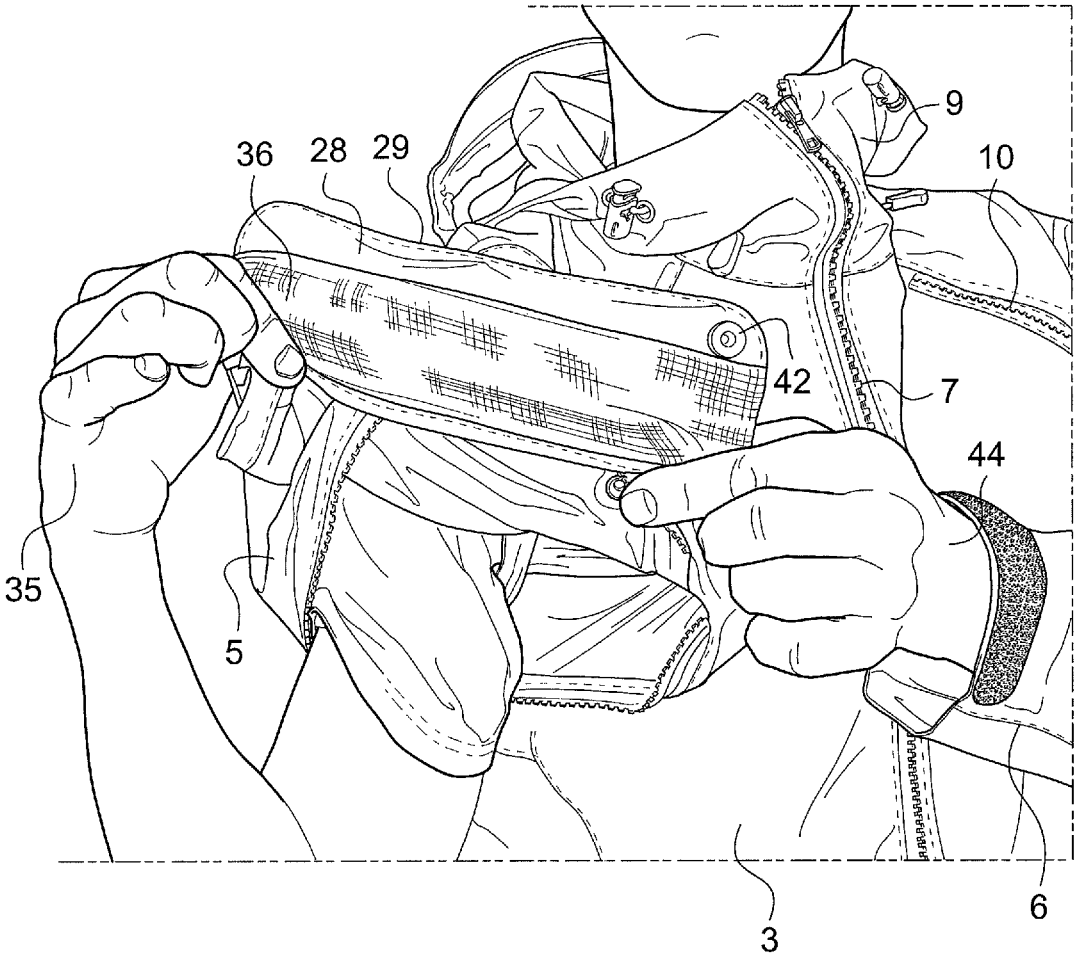
FIG. 9 is similar to FIG. 8, with the garment in the sleeve-less state with the proximal portion of the sleeve being lifted thereby showing the pocket filled with the rolled up sleeve and the black elastic band.

Distal portion 21 is then rolled-up by the wearer (see FIG. 7) and stowed within the pocket 28 (see FIGS. 8 and 9). While still wearing the jacket, the wearer can, with both hands, begin to roll up the sleeve, i.e., the loose portion of the sleeve from which the arm 35 has been removed. FIG. 7 shows the wearer grasping, with respective ones of his/her two hands, two spaced-apart, or opposite, ends of the rolled-up portion of the distal portion of the sleeve, thereby forming a roll extending transversely in relation to the length of the arm.

As shown In FIG. 8, the wearer holds the rolled up distal portion 21 with his/her left hand, while maintaining the pocket opened with the right hand.

FIG. 9 shows the garment in the sleeveless state, or with the length of the sleeve shortened to that of the proximal portion 19. More particularly, FIG. 9 shows the proximal portion 19 of the sleeve being raised, thereby showing the rolled-up distal portion contained within the pocket.

Figure 10:
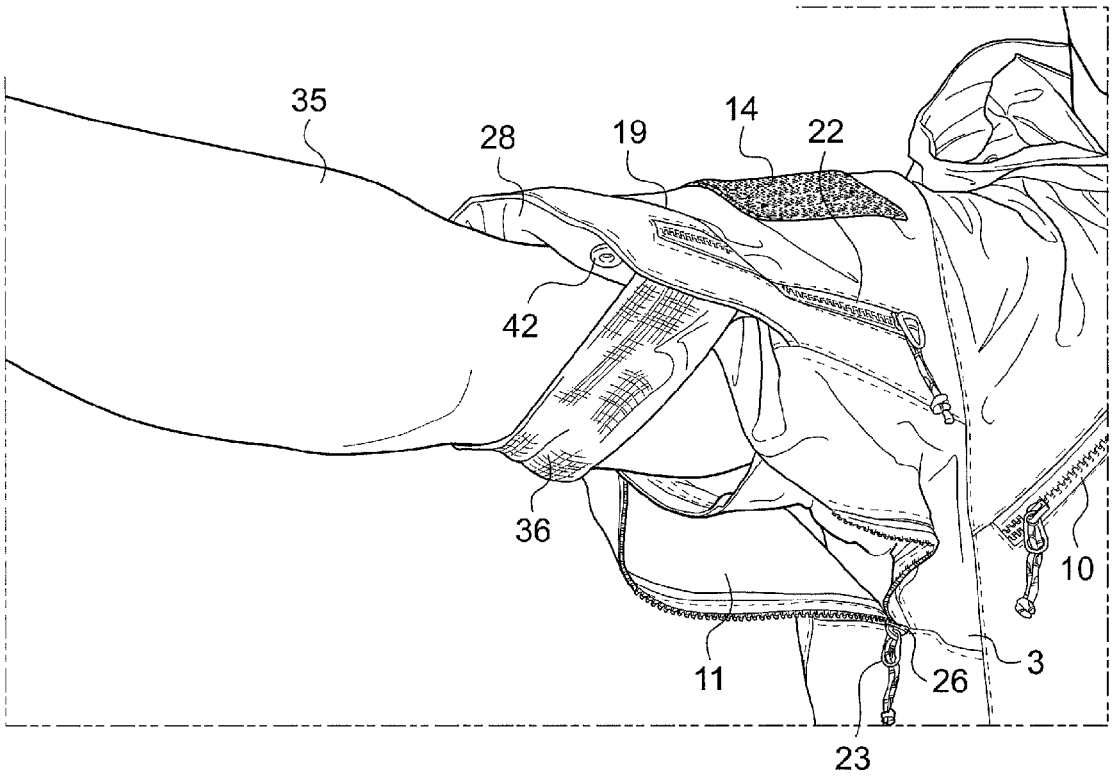
FIG. 10 is similar to FIG. 9 with the arm being inserted between the proximal portion of the sleeve and the elastic band.

In FIG. 10, the wearer has inserted his/her free arm 35 between the elastic band 36 and the proximal portion 19 to apply a firm but flexible tension to the distal portion 21 of the sleeve 5 against the arm 35 and hold the proximal portion 19 of the sleeve 5 against the upper portion of the arm 35. The rolled-up portion of the distal portion of the sleeve is shown, in FIG. 10, within the pocket 28 being held against the outer surface of the wearer's arm. With the garment in the shortened sleeve state, as shown in FIG. 10, the shortened sleeve stays in position through a full range of motion with minimal restriction and excellent comfort.

The wearer can readjust the closable opening 11 around his/her arm 35 by closing both sliders 23, 24 towards the middle or leave it open for a better ventilation of the armpit.

The garment 1 is thus in the second wear position in FIG. 11, i.e., the sleeveless, or shortened-sleeve state.

Then, the torso portion 3 is covered and kept warm by the garment 1 and the arms are now free from sleeve covering while the garment 1 provides a good protection of the shoulders, even in this sleeveless wear position. In addition, the zippered pocket of the proximal sleeve portion is still easily accessible via its zipper. Although a zipper is depicted, another type of fastener could be used instead.

Those steps are of course performed at both arms so that the wearer's arms are free from the sleeves 5, 6 without the necessity of removing the garment 1 from the wearer.

As can be seen by comparing FIG. 1 and FIG. 11, there is no compromise of the aesthetic of the garment with or without sleeve, as both are pleasant to the eye.

Figure 12:
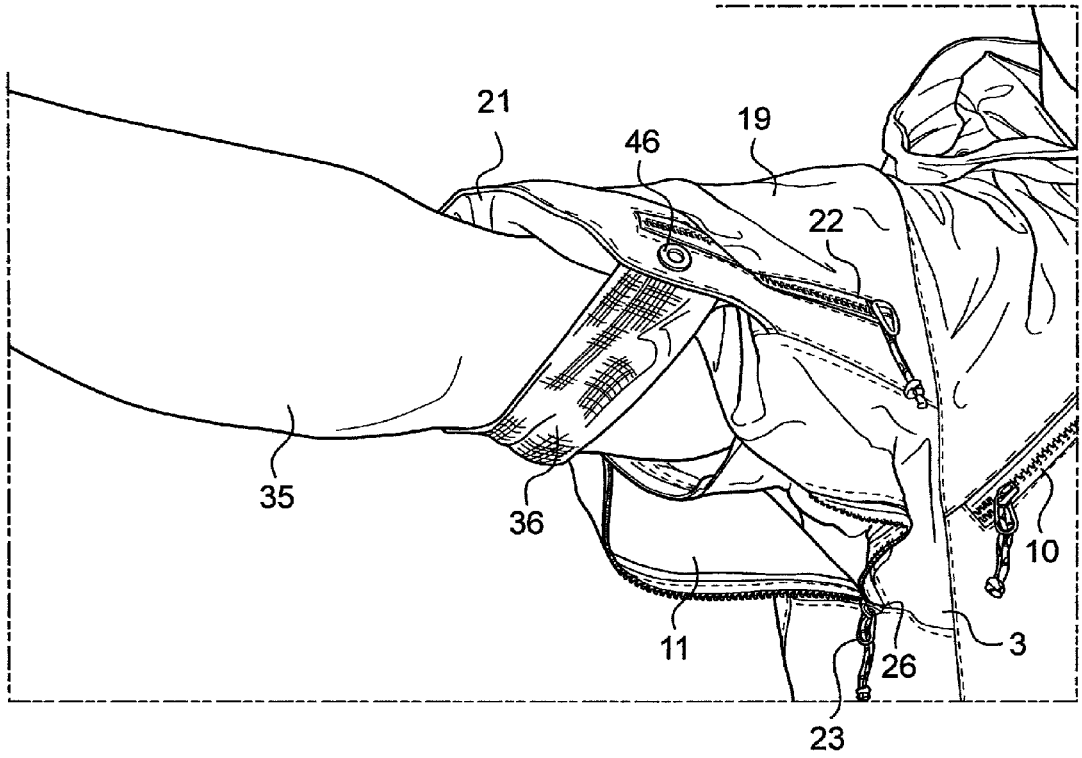
FIG. 12 is a similar view of FIG. 10 in a second embodiment of the invention in which the structural arrangement to maintain the distal portion of the sleeve in the rolled-up position comprises a snap.
Figure 13:
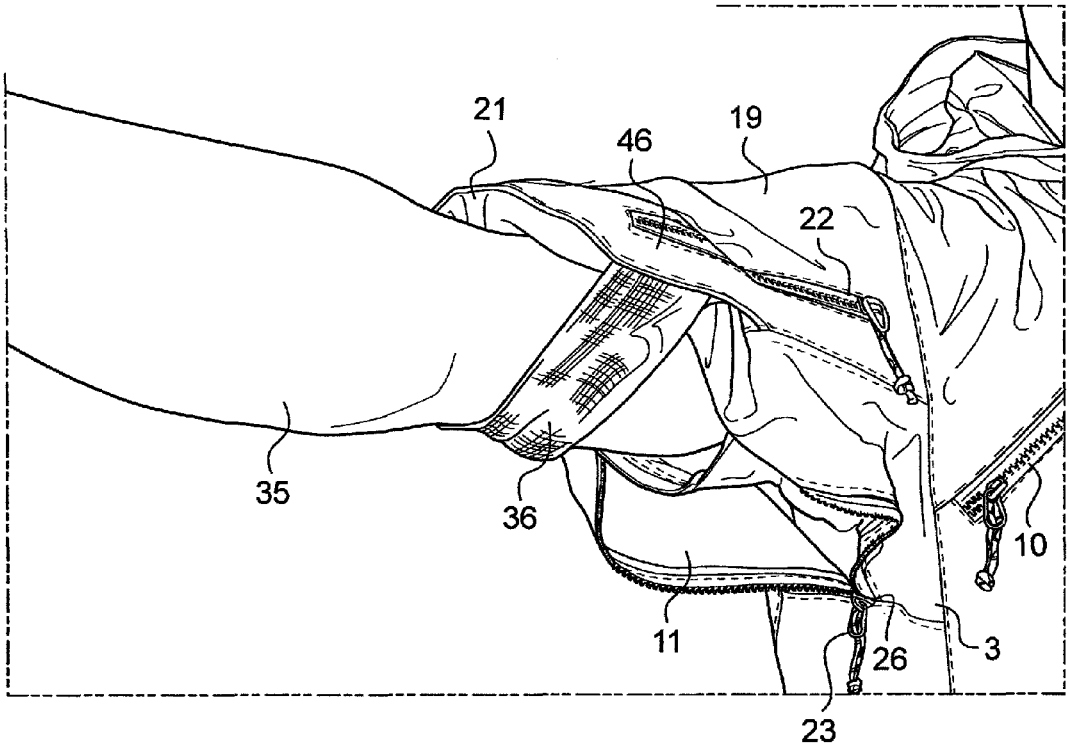
FIG. 13 is a similar view of FIGS. 10 and 12 in a third embodiment of the invention in which the structural arrangement to maintain the distal portion of the sleeve in the rolled-up position coincide with the structural arrangement to hold the proximal portion of the sleeve against the arm.

FIG. 12 and FIG. 13 show two other embodiments of the arrangement to maintain the sleeve 5 in a lifted-up state, in which the arrangement does not comprise a pocket.

In the second embodiment of FIG. 12, the arrangement for maintaining the distal portion 21 in a lifted-up state includes complementary, or mating, snaps 46. For example, female snap 46 is arranged on the proximal portion 19 and the mating male snap (not visible in the drawing) is arranged on the distal portion in such a position that when the distal portion is in the rolled-up state, the male snap faces the female snap. Further, although a single snap fastener is shown, a second or additional fastener could be located transversely spaced from that which is shown.

In the third embodiment of FIG. 13, the distal portion 21 is maintained in a rolled-up state by an elastic band. The elastic band coincides with the one 36 which holds the proximal portion 19 of the sleeve 5 against an upper arm 35 and which applies tension to the distal portion 21 of the sleeve 5 against the arm 35.

Thus, such a garment 1 does not need to be taken off prior to the removal of the sleeves 5, 6 and presents an excellent comfort for the wearer in both wear positions.

FIGS. 14-25 illustrate a fourth embodiment of the invention. In this embodiment, an interior pocket 28*a* (see, e.g., FIGS. 18, 19) for maintaining the rolled up distal end of a respective sleeve is positioned on the inside of the sleeve, such as sleeve 5*a*, i.e., directly engageable with the wearer's arm within the sleeve during use of the garment, rather than on the inside of a separate proximal sleeve portion (such as portion 19) as in the first embodiment. In addition, in place of an elastic band, the fourth embodiment includes an adjustable strap 36*a* which relies upon a hook-and-loop fastening arrangement (i.e., such as Velcro®) to secure the strap in place yet allow for the force applied to the rolled up distal portion of the sleeve to be adjusted as necessary or convenient for the wearer by adjusting the effective length of the strap.

Figure 25:
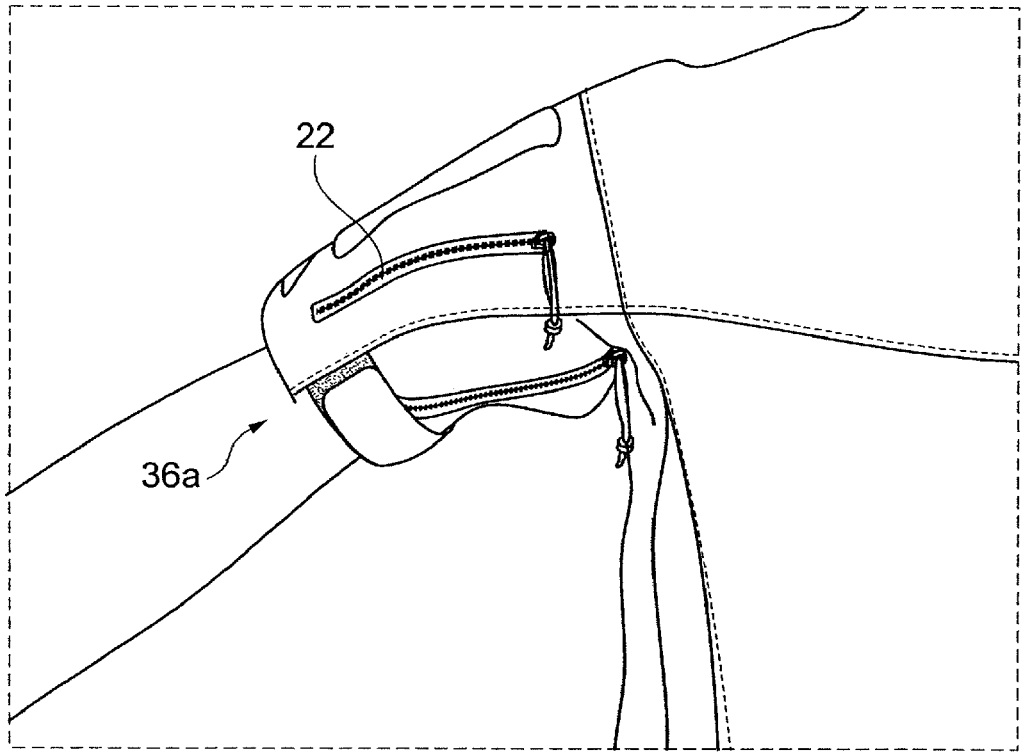

The figures of the fourth embodiment, like those of the first embodiment, represent the use of the garment 1*a* in a sequence from the garment being worn in a first normal sleeve-on state (FIG. 14, e.g.) to a second normal sleeve-less state (FIG. 25, e.g.).

Figure 14:
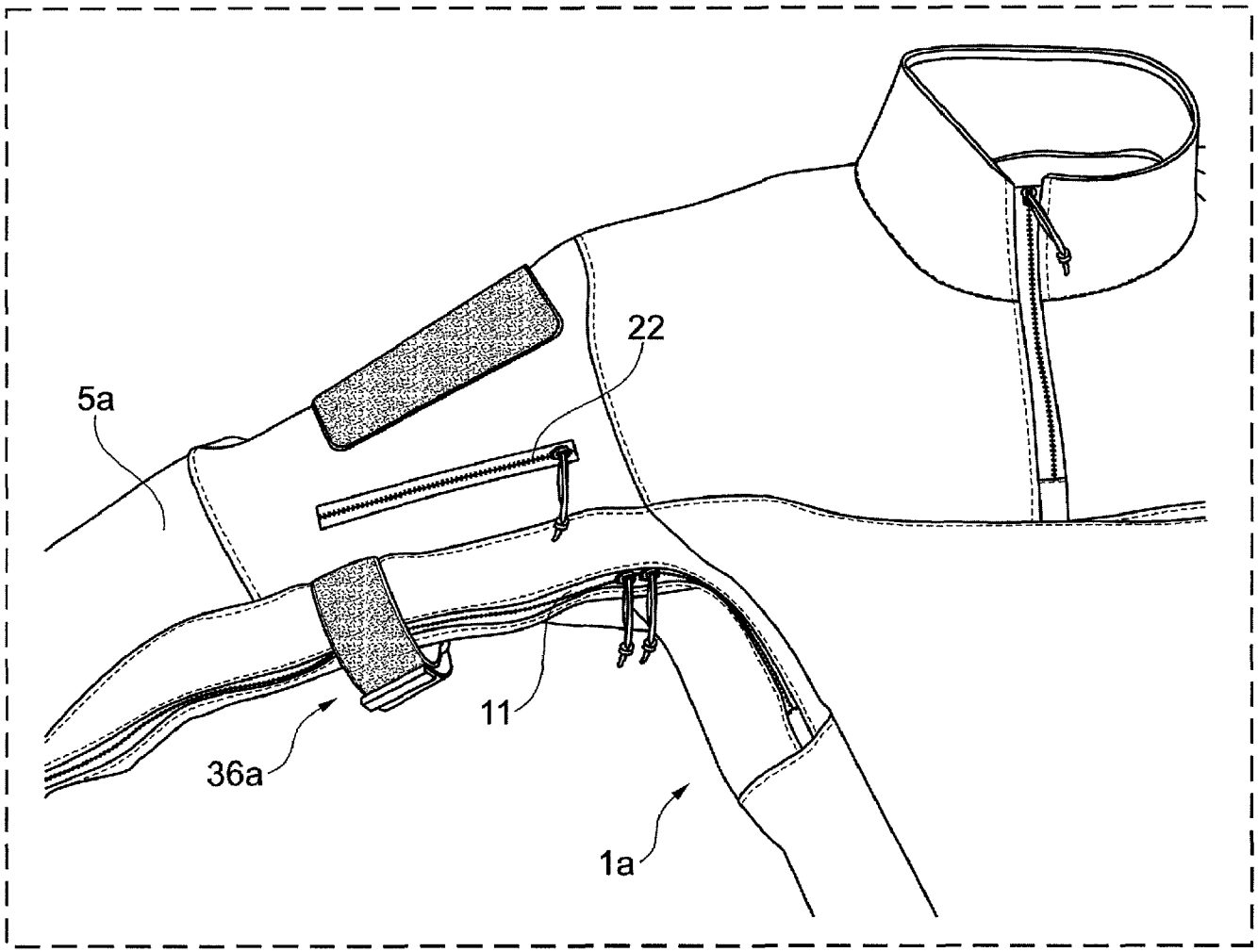
FIGS. 14 to 25 illustrate a fourth embodiment of the invention, whereby a pocket for maintaining the distal portion of the sleeve in a raised or rolled-up position is positioned on the inside of the sleeve, and whereby in place of an elastic band, an adjustable strap is provided on the outside of the sleeve and exterior of the lengthwise extending opening of the sleeve.

FIG. 14 shows the sleeve-on state of the garment 1*a*, with the zippered opening 11 in the closed state, with an adjustable strap 36*a* extending transversely around an underside of the sleeve 5*a*, on the outer side of the sleeve. The zipper, or slide fastener, can correspond to that of the first embodiment.

Figure 15:
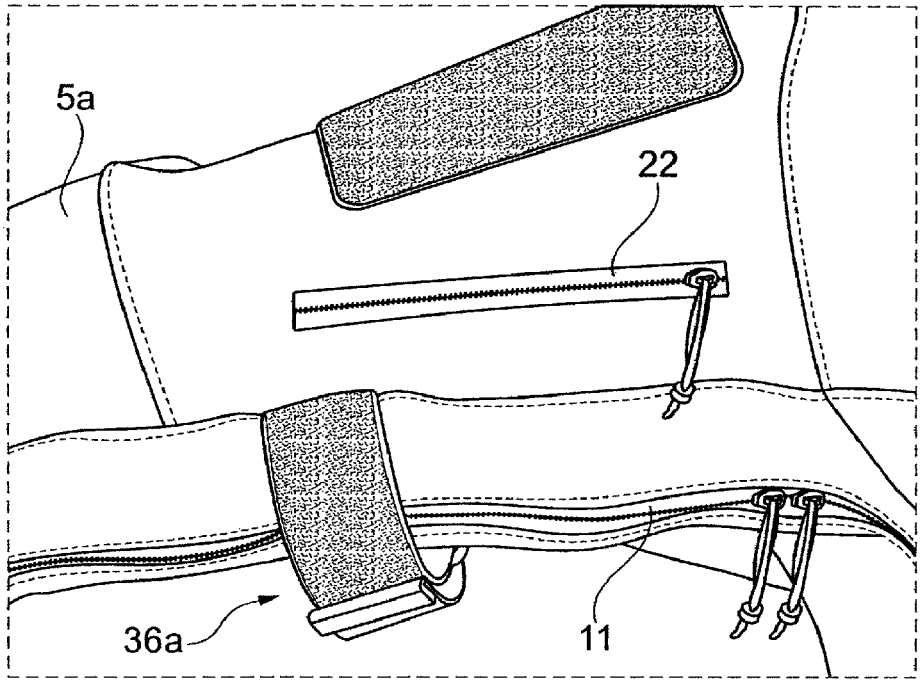
Figure 16:
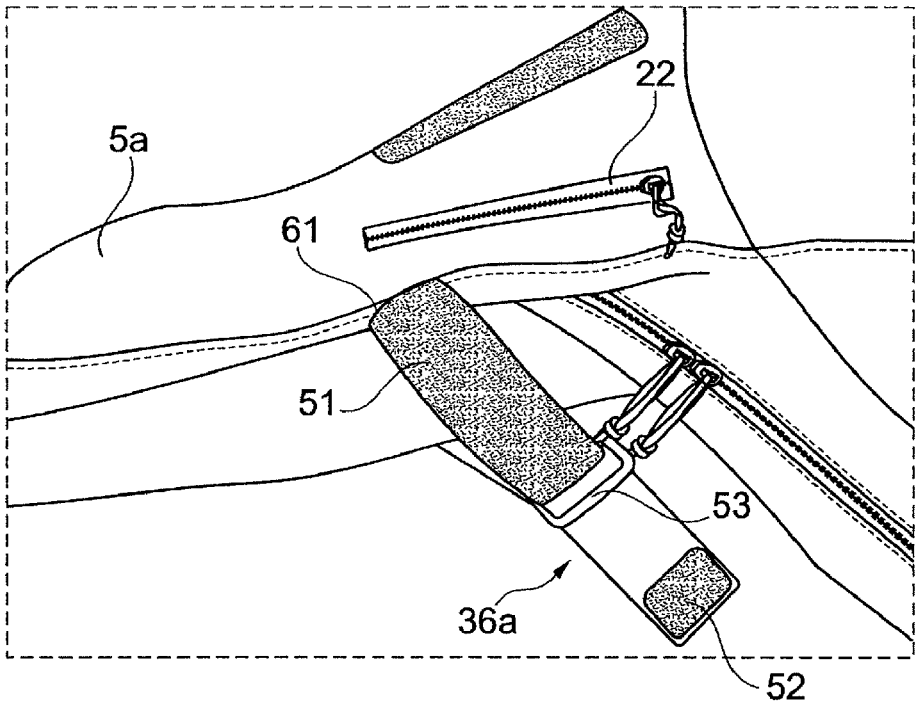

FIGS. 15 and 16 are views that are enlarged relative to that of FIG. 14. FIG. 15 shows the adjustable strap 36*a* in a secured fastened position, whereas FIG. 16 shows the adjustable strap 36*a* in an opened or loosened position, such as a position prior to adjustment, whereby the two mating pairs of the hook-and-loop fastener are separated. In this regard, the adjustable strap includes a first strap length that extends from an area 61 of connection to the sleeve (such as by stitching or otherwise) through a ring 53, the first strap portion having fixed thereon (such as through stitching or otherwise) a first 51 of the mating pairs of the hook-and-loop fastener, and the second strap portion having fixed thereon a second 52 of the mating pairs of the hook-and-loop fastener. The position of the second 52 of the pairs fixed upon the first 51 of the pairs being adjustable along the length of the first 51 of the pairs, thereby providing adjustability of the effective length of the strap 36*a*. A second strap length 54 (see FIG. 18) extends from an area 62 of connection to the sleeve (such as by stitching or otherwise) to the ring 53.

Figure 17:
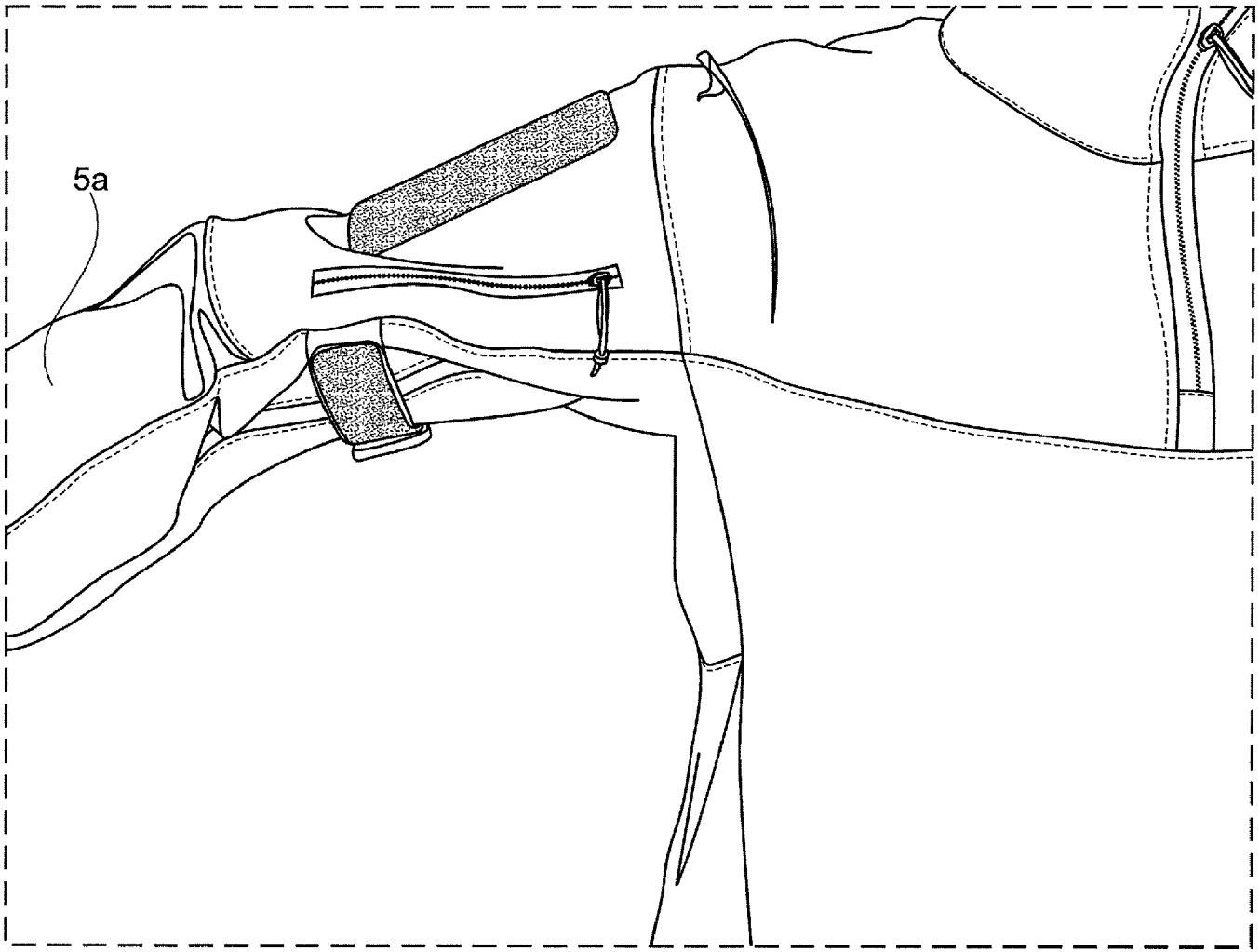

FIG. 17 shows the garment la in a sleeve-on state, with the right closable opening 11 (as identified in the foregoing embodiments) being closed by means of the zipper and the adjustable strap 36*a* extending over the zippered opening. In FIGS. 18-22, the right closable opening 11 of the sleeve has been opened so that the wearer's arm can be withdrawn from the sleeve 5*a* through the closable opening 11, as explained with regard to the first embodiment prior to the wearer rolling up the distal portion of the sleeve 5*a*.

Figure 18:
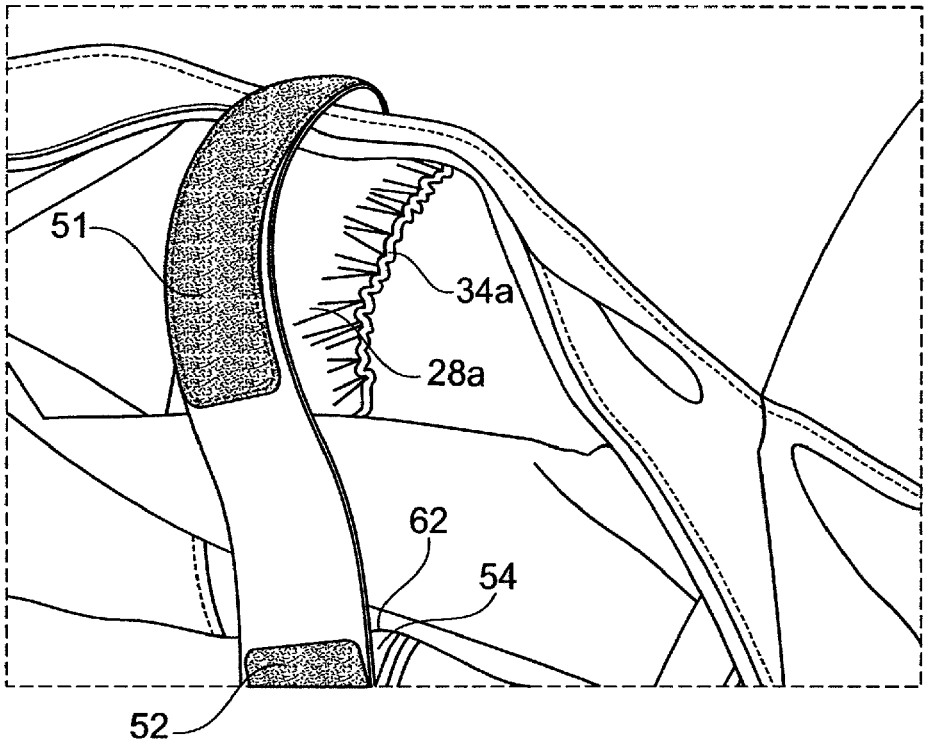
Figure 19:
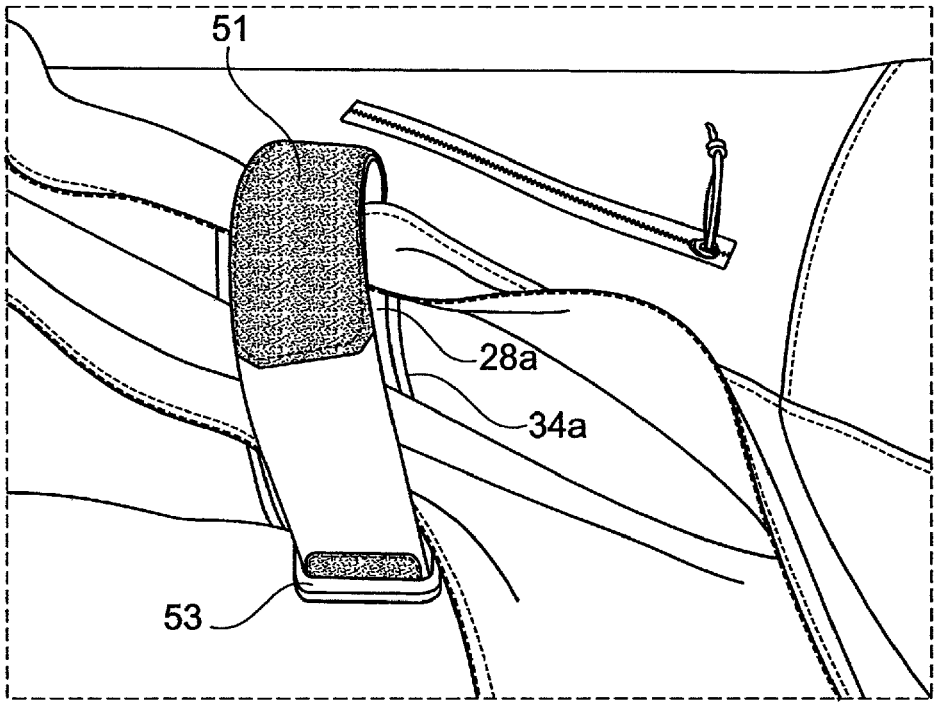

FIGS. 18 and 19 illustrate the pocket 28*a* into which the rolled up distal portion of the sleeve is to be stowed. It is here noted that the edge 34*a* of the pocket 28*a* could, in an optional variation, be covered with an overlapping flap (not shown), i.e., overlapping from a fixed edge to a free edge in a direction away from the torso portion of the garment la. Such a flap could be found convenient for the wearer, while donning the jacket, in avoiding catching his/her fingers or hand within the pocket 28*a*.

Figure 20:
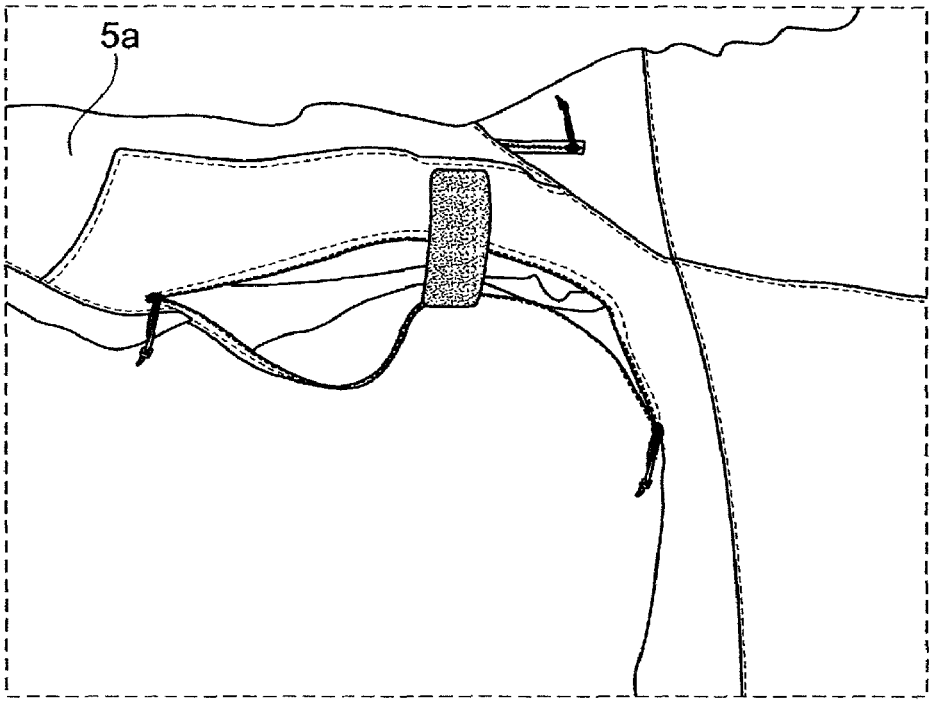
Figure 21:
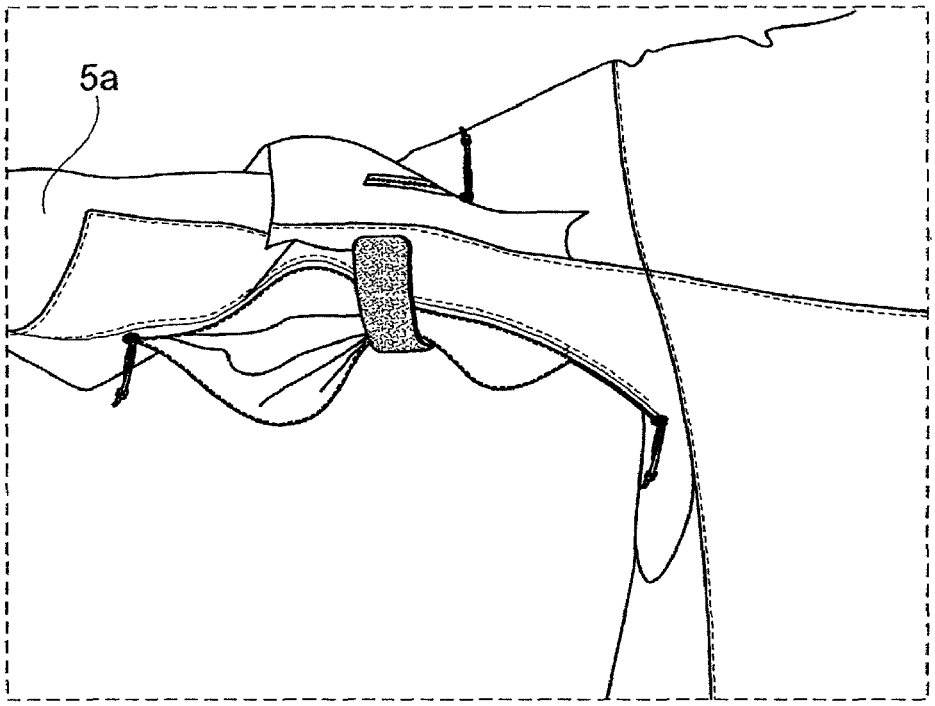
Figure 22:
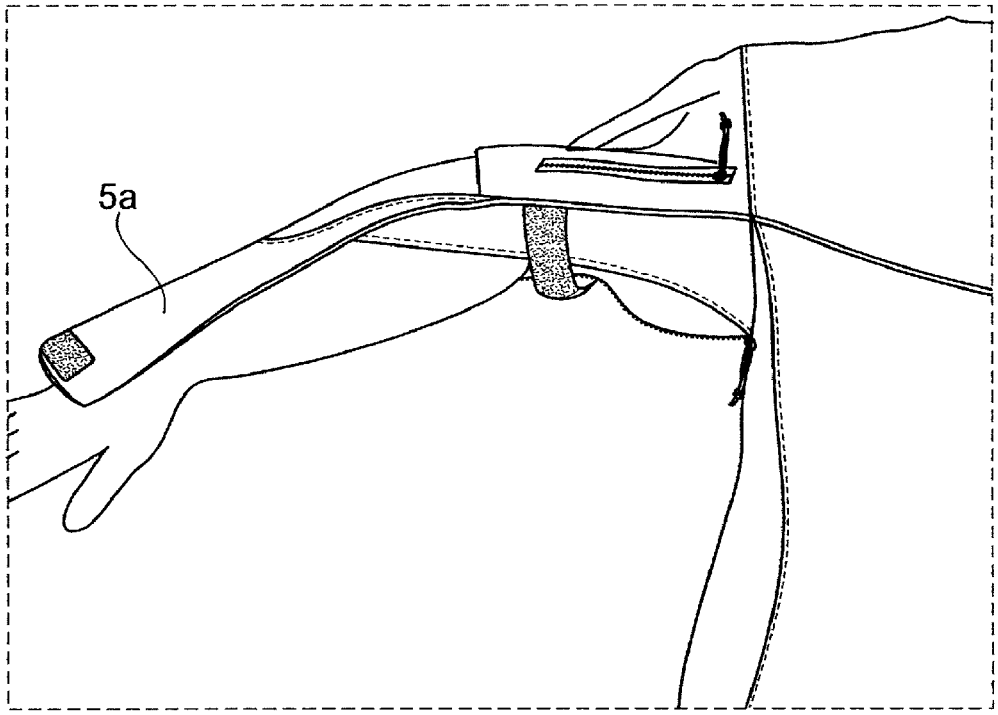

In the sequence successively depicted in FIGS. 20-22, with the zippered opening 11 in the open state, the wearer readies the sleeve 5*a* (FIGS. 20, 21) for withdrawal of his/her arm from distal portion of the sleeve 5*a* through the opening 11 and then the wearer removes his/her arm from the opening (FIG. 22), with the distal portion of the sleeve 5*a* being readied to be rolled up.

Figure 23:
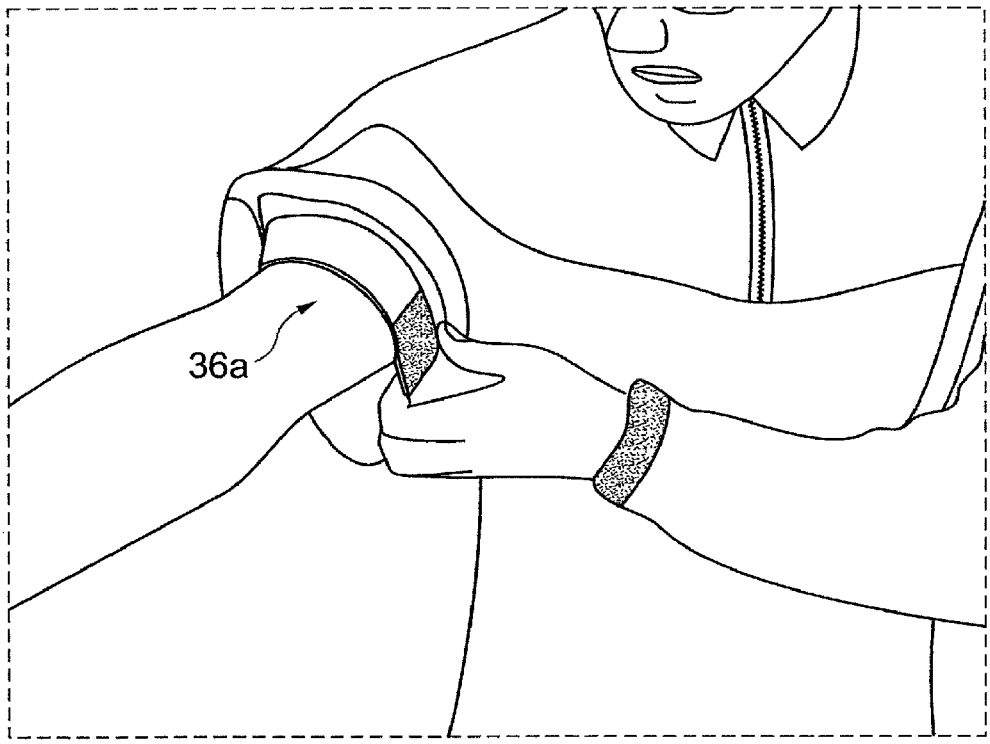
Figure 24:
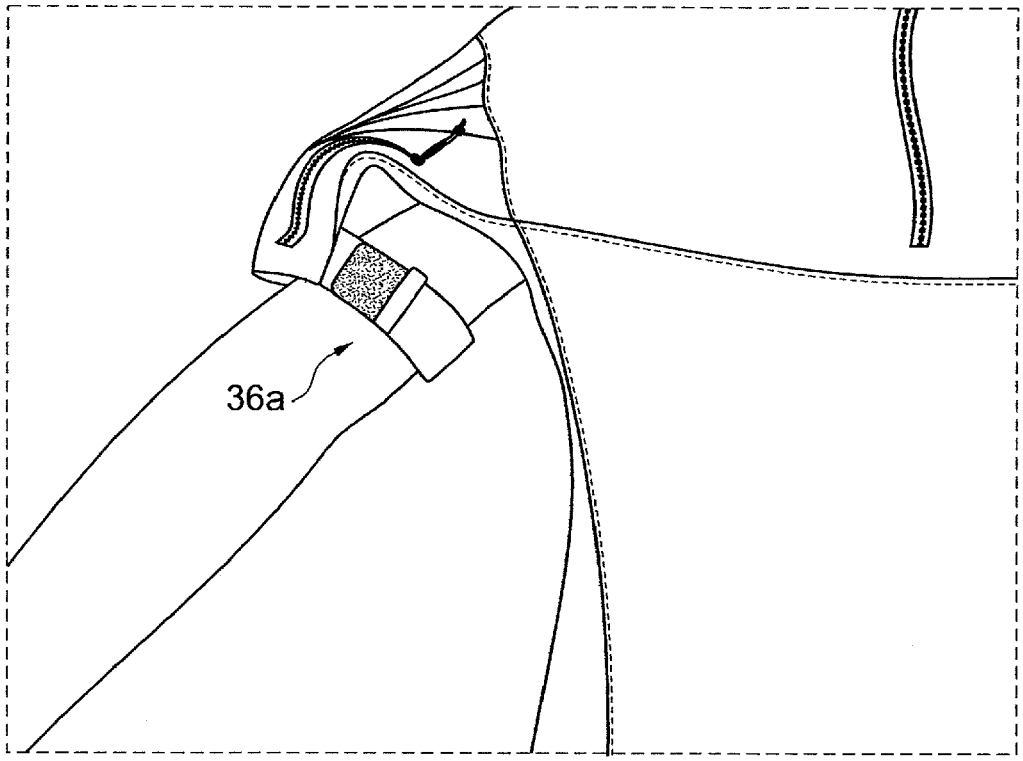

The distal portion of the sleeve is then rolled-up by the wearer and stowed within the pocket 28*a* (see FIGS. 23-25).

As shown In FIG. 23, the wearer can adjust the adjustable strap 36*a*, if necessary, such as to tighten the strap, particularly if the wearer had loosened the strap after having opened the opening 11.

FIGS. 24, 25 show the garment 1*a* in the sleeveless state, i.e., in the sleeve-shortened state. From the position of the shortened sleeve state shown in FIG. 24, the wearer can adjust the proximal portion of the sleeve to have it lie smoothly against the upper arm, as shown in FIG. 25, whereby the pull tab(s) of the slider(s) of the zipper of the opening 11 can be pulled slightly downwardly, giving the shortened sleeve a better aesthetic and comfortable fit. Alternatively, the opening can be left open somewhat for ventilation.

In FIG. 25, the wearer's arm is positioned between the adjustable strap 36*a* and the shortened portion of the sleeve 5*a*, i.e., the proximal portion, whereby the tension applied by the adjustable strap is set by the wearer to be firm but comfortable in maintaining the rolled-up and pocketed distal portion of the sleeve 5*a* against the upper arm. With the garment 1*a* in the shortened sleeve state, as shown in FIG. 25, the shortened sleeve stays in position through a full range of motion with minimal restriction and excellent comfort.

The garment 1*a* is thus in the second wear position in FIG. 25, i.e., the sleeveless, or shortened-sleeve state.

Then, the wearer's torso is covered and kept warm by the garment 1*a* and the arms are now free from sleeve covering while the garment 1*a* provides a good protection of the shoulders, even in this sleeveless/shortened sleeve wear position. In addition, the zippered pocket 22 of the proximal sleeve portion is still easily accessible via its zipper. Although a zipper is depicted, another type of fastener could be used instead.

The aforementioned steps are, of course, performed for both sleeves of the garment so that both of the wearer's arms are free from the sleeves without the necessity of the garment 1*a* being removed from the wearer.

As with the first embodiment, there is no compromise in the appearance of the garment with or without the full sleeve, as both are pleasant to the eye.

Figure 26:
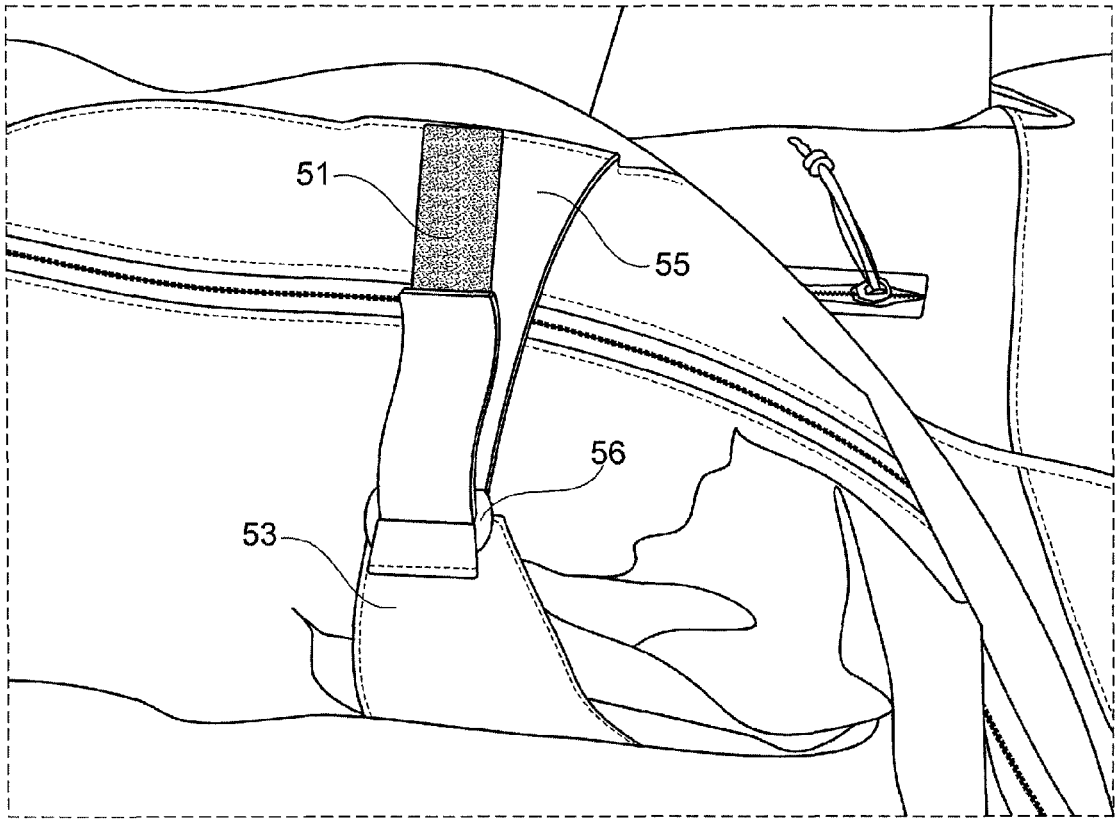
FIG. 26 illustrates a variation of a particular aspect of the fourth embodiment.

FIG. 26 illustrates a variation of the adjustable strap of the fourth embodiment, whereby rather than the strap having a uniform width (such as the lengths of the straps bearing the mating pairs of the hook-and-loop fastener mentioned above), each of the lengths of the strap 55, 56 that are connected at the ring 53 extend from the ring through progressively widened portions to their attachment to the sleeve.

The invention is not limited to the particular illustrated embodiments described hereinabove, and includes all of the technical equivalents that fall within the scope of the claims which follow.

For example, the examples of an adjustable strap have been described and illustrated with particularity; however, the invention encompasses other structures equivalent thereto which are consistent with the disclosure herein.

Further, the invention, illustratively disclosed herein, suitably may be practiced in the absence of any element which is not specifically disclosed herein.

The invention claimed is:

1. A garment comprising:

a torso portion;

a pair of sleeves;

a pair of closable openings, each of the openings extending between the torso portion and a respective one of the pair of sleeves;

each of said pair of closable openings comprising:

a first portion positioned on a respective underarm, extending along a side of the torso portion;

a second portion extending on a respective one of the sleeves;

each of said sleeves comprising:

a proximal portion adjacent to the torso portion;

a distal portion;

an arrangement carried by the proximal portion constructed and arranged to maintain the distal portion in a lifted-up state;

said arrangement for maintaining the distal portion in a lifted-up state including an interior pocket carried by the proximal portion, said pocket being structured and arranged to contain at least a portion of the distal portion in the lifted-up state;

said interior pocket including an interior opening for receiving the distal portion of the sleeve in the lifted-up state.

2. A garment according to claim 1, wherein:

said lifted-up state comprises a rolled-up state in which the distal portion of a sleeve has been rolled-up upon itself with an arm of the wearer extending through one of the pair of closable openings.

3. A garment according to claim 2, wherein:

said proximal portion of the sleeve further comprises an arrangement to hold the rolled-up proximal portion of the sleeve against an upper arm of a wearer, without an arm of the wearer extending through the rolled-up distal portion.

4. A garment according to claim 3, wherein:

said arrangement to hold the proximal portion of the sleeve against an upper arm of a wearer comprises a band applying an elastic force pulling the rolled-up distal portion against the upper arm of the wearer.

5. A garment according to claim 3, wherein:

said arrangement to hold the proximal portion of the sleeve against an upper arm of a wearer comprises a strap having an arrangement to adjust an effective length of the strap.

6. A garment according to claim 1, wherein:

said pocket is attached to an inside surface of the sleeve directly engageable with an arm of the wearer during use of the garment, an outer surface of the sleeve covering the pocket from view in both the lifted-up state of the distal portion and in a non-lifted-up state.

7. A garment according to claim 1, wherein:

said arrangement for maintaining the distal portion in a lifted-up state includes snaps.

8. A garment according to claim 1, wherein:

the proximal portion and the distal portion comprise snaps to maintain the proximal portion against the distal portion.

9. A garment according to claim 1, wherein:

said arrangement for maintaining the distal portion is positioned on an upper part of the proximal portion.

10. A garment according to claim 1, wherein:

said closable opening between the torso portion and the respective sleeve comprises a substantially U-shaped closable-opening with a first portion oriented substantially vertically and a second portion oriented substantially vertically.

11. A garment according to claim 1, wherein:

said closable opening between the torso portion and the respective sleeve comprises a double slider zipper.

12. A garment according to claim 1, wherein:

the first portion positioned on each underarm, extending along a side of the torso portion and the second portion extending on the respective one of the sleeves belong to the same piece of fabric.

13. A garment according to claim 1, wherein:

the proximal portion comprises a lining.

14. A garment according to claim 1, wherein:

said arrangement for maintaining the distal portion in a lifted-up state includes an elastic band adapted to extend at least partially around a wearer's arm to apply tension to the lifted-up distal portion of the sleeve against the arm.

15. A garment according to claim 1, wherein:
in the lifted-up state, at least a portion of the distal portion of a sleeve has a shape of a roll with spaced-apart ends;
in the lifted-up state, the roll is received within the pocket.

16. A garment according to claim 15, wherein:
the pocket is attached to and forms a flap on an outer surface of the proximal portion;
the pocket has an upward-facing opening, for receiving the rolled-up portion of the distal portion, and a bottom spaced downwardly from the opening, the bottom of the pocket forming a free end of the flap.

17. A garment according to claim 16, wherein:
the pocket is an interior pocket, the flap having an outer surface covering the opening of the pocket from view.

18. A garment according to claim 1, wherein:
said arrangement for maintaining the distal portion in a lifted-up state includes an elastic band extending only partially around a wearer's arm, between first and second spaced-apart ends of the band, to apply tension to the lifted-up distal portion of the sleeve against the arm.

19. A garment according to claim 1, wherein:
said arrangement for maintaining the distal portion in a lifted-up state includes a band, separate from and affixed to the sleeve, said band extending only partially around a wearer's arm, between first and second spaced-apart ends of the band, to hold the lifted-up distal portion of the sleeve against the arm.

20. A garment comprising:
a torso portion;
a pair of sleeves attached to the torso portion;
each of said sleeves comprising:
a proximal portion adjacent to the torso portion;
a distal portion;
the garment being structured and arranged to reconfigure each of the sleeves from a sleeve extended configuration to a sleeve rolled-and-stowed configuration;
in the sleeve extended configuration, the proximal portion of a respective sleeve and the distal portion of the respective sleeve are structured and arranged to extend around respective ones of an upper portion and a lower portion of an arm of the wearer;
in the sleeve rolled-and-stowed configuration, the wearer's arm is not within the distal portion of the respective sleeve and the distal portion of the respective sleeve is rolled upon itself;
means enabling the garment to be reconfigured from the extended sleeve configuration to the rolled-and-stowed configuration while the sleeves remain attached to the torso portion of the garment and while the torso portion of the garment is positioned around a torso of the wearer;
a respective retention device attached to the proximal portion of each of the sleeves to retain respective sleeves in the rolled-and-stowed configuration;
the retention device comprising a band or strap.

21. A garment according to claim 20, wherein:
the means enabling the garment to be reconfigured comprises:
a pair of closable openings extending from the torso portion and along lengths of respective ones of underarm portions of the pair of sleeves;
each of the pair of closable openings being structured and arranged to enable respective hands and arms of the wearer to be removed from respective distal portions and extended through respective ones of the pair of closable openings.

22. A garment according to claim 20, wherein:
the retention device is mounted to an outer surface of the proximal portion of the sleeve.

23. A garment according to claim 22, wherein:
the band or strap is structured and arranged to apply a force on the distal portion of the sleeve in a direction to maintain the distal portion of the sleeve in the rolled-and-stowed configuration .

24. A garment according to claim 20, wherein:
the band or strap is an elastic band.

25. A garment according to claim 20, wherein:
at least a portion of the retention device is mounted to an inside surface of the proximal portion in the sleeve extended configuration.

26. A garment according to claim 25, wherein:
the retention device further comprises a pocket.

27. A garment according to claim 22, wherein:
the retention device further comprises a pocket.

28. A garment according to claim 23, wherein:
the band or strap is structured and arranged to apply a retention force tending to bring the proximal portion of the respective sleeve toward the arm.

29. A garment according to claim 20, wherein:
in the sleeve rolled-and-stowed configuration, the distal portion of the respective sleeve is hidden beneath the proximal portion.

30. A garment according to claim 20, wherein:
the band or strap is an adjustable strap comprising structure to allow a selective adjustment of an effective length of the strap.

31. A garment according to claim 20, wherein:
the retention device comprises an adjustable strap and includes a hook-and-loop fastening arrangement to secure the strap in place.

32. A garment according to claim 20, wherein:
in the sleeve rolled-and-stowed configuration, the distal portion of the respective sleeve is rolled upon itself to form a roll extending transversely in relation to the wearer's arm.

33. A garment according to claim 20, wherein:
the band or strap extends at least partially around the wearer's arm.

34. A garment according to claim 20, wherein:
the retention device further comprises complementary parts, a first of the parts being arranged on the proximal portion of the respective sleeve and a second of the parts being arranged on the distal portion.

35. A garment according to claim 34, wherein:
the first and second of the complementary parts of the fastener are male and female snap fasteners.

36. A garment according to claim 34, wherein:
the band or strap extends at least partially around the wearer's arm to retain the distal portion of the respective sleeve toward the arm.

37. A garment according to claim 34, wherein:
in the sleeve rolled-and-stowed configuration, the distal portion of the respective sleeve is rolled upon itself to form a roll extending transversely in relation to the wearer's arm.

* * * * *